US011384567B2

(12) United States Patent
Derakhshan

(10) Patent No.: US 11,384,567 B2
(45) Date of Patent: Jul. 12, 2022

(54) SMART LOCK SYSTEM AND PROCESS

(71) Applicant: INTELLACTUATE PTY LTD, St Kilda (AU)

(72) Inventor: Behzad Derakhshan, St Kilda (AU)

(73) Assignee: INTELLACTUATE PTY LTD, St Kilda (AU)

( * ) Notice: Subject to any disclaimer, the term of this patent is extended or adjusted under 35 U.S.C. 154(b) by 285 days.

(21) Appl. No.: 16/744,758

(22) Filed: Jan. 16, 2020

(65) Prior Publication Data

US 2020/0232256 A1 Jul. 23, 2020

Related U.S. Application Data

(60) Provisional application No. 62/793,505, filed on Jan. 17, 2019.

(51) Int. Cl.

| | |
|---|---|
| ***E05B 49/00*** | (2006.01) |
| ***G07C 9/00*** | (2020.01) |
| ***E05B 47/00*** | (2006.01) |
| ***E05B 37/14*** | (2006.01) |

(52) U.S. Cl.

CPC ..... *E05B 49/00* (2013.01); *G07C 9/00309* (2013.01); *G07C 9/00817* (2013.01); *E05B 37/14* (2013.01); *E05B 47/0001* (2013.01); *E05B 2047/002* (2013.01); *E05B 2047/0058* (2013.01); *G07C 2009/00825* (2013.01)

(58) Field of Classification Search

CPC ..... E05B 49/00; E05B 37/14; E05B 47/0001; E05B 2047/002; E05B 2047/0058; E05B 47/0003; E05B 49/006; E05B 37/025; G07C 9/00309; G07C 9/00817; G07C 2009/00825

USPC ..... 340/5.6

See application file for complete search history.

(56) References Cited

U.S. PATENT DOCUMENTS

| | | | | |
|---|---|---|---|---|
| 5,245,652 | A * | 9/1993 | Larson | G07C 9/00896 235/382.5 |
| 5,668,876 | A * | 9/1997 | Falk | G06Q 20/363 705/72 |
| 6,359,547 | B1 * | 3/2002 | Denison | B60R 25/102 340/663 |
| 6,484,260 | B1 * | 11/2002 | Scott | G07F 7/1008 713/182 |
| 7,236,085 | B1 * | 6/2007 | Aronson | E05B 47/0603 109/46 |
| 7,606,558 | B2 * | 10/2009 | Despain | H04W 12/082 455/410 |

(Continued)

*Primary Examiner* — Nam V Nguyen

(74) *Attorney, Agent, or Firm* — Nixon & Vanderhye, PC

(57) ABSTRACT

A combination lock including: locking means configured to be moveable between a first position in which the lock is placed in a locking state and a second position in which the lock is placed in an unlocked state; a set of mechanical combination reels operable by a user of the lock to configure the reels in accordance with a selected input combination; and a controller having a network interface and being configured to receive via the network interface one or more unlock input combinations associated with the unlocked state of the lock, and wherein the controller is configured to operate the locking means to place the lock in the unlocked state when an input combination of the mechanical combination reels matches any one of the one or more unlock input combinations.

22 Claims, 18 Drawing Sheets

(56) References Cited

U.S. PATENT DOCUMENTS

| | | | | |
|---|---|---|---|---|
| 7,832,238 | B2 * | 11/2010 | Misner | E05B 37/0034 70/432 |
| 8,453,481 | B2 * | 6/2013 | Meekma | E05B 67/22 70/278.1 |
| 8,756,431 | B1 * | 6/2014 | Despain | G06F 21/305 713/176 |
| 9,460,480 | B2 * | 10/2016 | Woodard | G06Q 10/1095 |
| 9,670,694 | B2 * | 6/2017 | Larson | G07C 9/00309 |
| 9,894,066 | B2 * | 2/2018 | Conrad | H04L 67/34 |
| 2013/0043973 | A1 * | 2/2013 | Greisen | G07C 9/00817 340/5.51 |

* cited by examiner

SMART LOCK SYSTEM AND PROCESS

This application claims the benefit of U.S. Application No. 62/793,505 filed 17 Jan. 2019, the entire contents of which is hereby incorporated by reference.

TECHNICAL FIELD

The present invention relates to a smart lock, lock management system, and process for remotely controlling the operation of a smart lock, and specifically the configurations of components of the smart lock which are effective to open the lock.

BACKGROUND

Locks in the form of mechanical or electronic devices are widely used to secure access to a resource, such as by fastening one or more objects together to create a physical impediment which, ideally, cannot be traversed without opening, and in some cases subsequently removing, the lock. For example, locks are often implemented to control access to particular spaces by securing a door, or other type of movable barrier, into position. In conventional locks, the fastening functionality of the lock is provided by set of locking components which are mechanical in nature, where the state of the lock is determined by the configuration of the locking components relative to a specific unlocking configuration.

For example, in a pin tumbler lock the locking components are pins of different lengths whose ends are brought into mutual alignment by the grooves of a key shaped object when that object is inserted into the tumbler. The unlocking configuration is the specific alignment of the pins with the abutting cylindrical surfaces of an inner and outer cylinder of the lock, allowing the inner cylinder to rotate within the outer cylinder and the lock to transition to an open state (i.e. where the fastener of the lock moves from a locked position to an unlocked position). More generally, in conventional mechanical locks a user manually manipulates the locking components in order to open the lock by setting the present configuration of the locking components (i.e. the "selected configuration") to an unlocking configuration.

Smart locks are fastening devices in which the state of the lock (i.e. as closed or open) is altered based on signals received from an electronic device. Conventional smart locks operate by automatically configuring the locking components, such that the fastener is placed into a locked or unlocked position (corresponding to the closed and open states of the lock respectively), based on electronic data that is transmitted to the smart lock from a device, such as a programmable hardware device (e.g., a key fob) or a smartphone. Operation of the lock involves comparing unlocking data stored within electronic components of the smart lock with authentication data provided by the user (i.e. via an electronic signal emitted by the fob or smartphone device). These locks are often deployed in situations where it is desired to permit or deny a particular user access to the lock without requiring the user to physically interact with the locking components.

Despite the convenience of these lock technologies, there remains room for improvement. It is desired, therefore, to provide a lock, a lock management system, and/or a process for managing a lock that alleviates one or more difficulties of the prior art, or to at least provide a useful alternative.

SUMMARY

According to some embodiments of the present invention, there is provided a combination lock including:

- locking means configured to be moveable between a first position in which the lock is placed in a locking state and a second position in which the lock is placed in an unlocked state;
- a set of mechanical combination reels operable by a user of the lock to configure the reels in accordance with a selected input combination; and
- a controller having a network interface and being configured to receive via the network interface one or more unlock input combinations associated with the unlocked state of the lock, and wherein the controller is configured to operate the locking means to place the lock in the unlocked state when an input combination of the mechanical combination reels matches any one of the one or more unlock input combinations.

According to some embodiments of the present invention, there is provided a lock management system for managing a lock, including:

- a lock management device, including:
  - a communications interface to receive data;
    - at least one computer processor to execute program instructions; and
    - a memory, coupled to the at least one computer processor, to store program instructions for execution by the at least one computer processor to automatically:
    - generate lock selection data representing the selection of a lock from one or more combination locks registered to an administrator of the lock management device;
    - generate lock configuration data including an indication of one or more unlock input combinations of a set of mechanical combination reels of the selected lock, said set of mechanical combination reels being operable by a user to configure the reels in accordance with a desired input combination, the one or more unlock input combinations being associated with an unlocked state of the selected lock; and
    - transmit the lock configuration data to the selected lock via the communications interface, and
  - where the selected lock is a combination lock in accordance with the lock described herein above.

According to some embodiments of the present invention, there is provided a lock management system for managing a combination lock, including:

- a lock management device, including:
  - a communications interface to receive data;
    - at least one computer processor to execute program instructions; and
    - a memory, coupled to the at least one computer processor, to store program instructions for execution by the at least one computer processor to automatically:
    - generate lock selection data representing the selection of a lock from one or more combination locks registered to an administrator of the lock management device; and
    - generate lock configuration data including an indication of one or more unlock input combinations of a set of mechanical combination reels of the selected lock, said set of mechanical combination reels being operable by a user to configure the reels in accordance with a desired input combination, the one or more unlock input combinations being associated with an unlocked state of the selected lock, where the one or more unlock input combinations of the generated lock configuration data are the same one or more unlock input combinations that are determined via an unlock combination generation process of the selected lock, and where the selected lock is a combination lock in accordance with the lock described herein above.

According to some embodiments of the present invention, there is provided a process for managing a combination lock, including:

storing, within the combination lock, unlock input combination data representing one or more unlock input combinations of the combination lock, the combination lock having a set of mechanical combination reels being operable by a user of the combination lock to configure the reels in accordance with a desired input combination;

comparing, by the combination lock, data representing the configuration of the set of mechanical combination reels to data representing the one or more unlock input combinations;

generating, by the combination lock, when the configuration of the set of mechanical combination reels matches to an unlock input combination represented by the unlock input combination data, fastener control signals to cause one or more fastening components to move a fastener from a first position in which the combination lock is placed in a locking state to a second position such as to place the combination lock in an unlocked state; and updating, by the combination lock, the stored unlock input combination data in response to lock configuration data received from a lock management device, said lock configuration data including an indication of one or more specified unlock input combinations that are to be added to, or removed from, the set of stored unlock input combinations.

BRIEF DESCRIPTION OF THE DRAWINGS

Some embodiments of the present invention are hereinafter described, by way of example only, with reference to the accompanying drawings, wherein.

DETAILED DESCRIPTION

Overview

Figure 1:
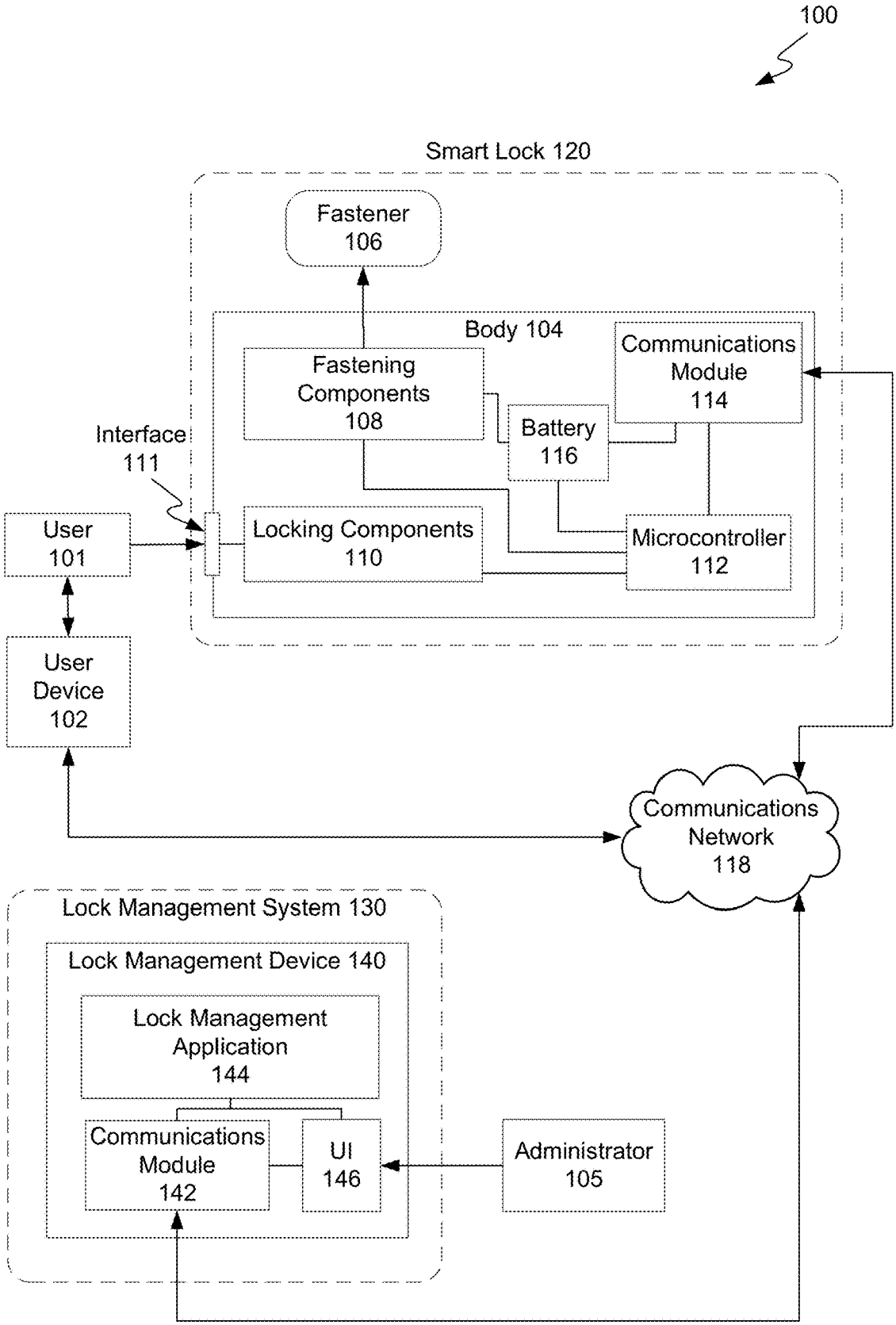
FIG. 1 is a block diagram of a smart lock system in accordance with some embodiments of the present invention.

The inventors have identified some specific shortcomings with existing smart lock technologies. Many of these locks rely on electronic transmission of data between a device of the user (such as a smart phone, fob, or access card) and the lock in order to effect a change in the state of the lock. That is, the locking components are electronic and are configured to receive electronic authentication data, and to compare this data to the unlocking data stored within the smart lock in order to determine whether to transition the lock from a closed to an open state. These smart locks can be advantageous where permission to open the lock needs to be granted, or revoked, dynamically with respect to one or more users, since the unlocking data can be modified in an ad hoc fashion.

However, the reliance of these locks on another tool or device (an "access device") for their operation has several disadvantages. For example, the smart lock may be operated by a FOB, or similar RFID type chip, as embedded in a wrist band or key card. Alternatively, or in addition, the lock may be operated by a smart-phone, or similar mobile device, based on a close proximity wireless communication technology (such as RF or Bluetooth). These configurations have several disadvantages. For example, if the access tool or device is unavailable, misplaced or damaged (e.g., is faulty or has a flat battery in the case of a mobile device), then the lock will not be able to be operated.

Electronic components of conventional smart locks also typically possess significantly higher failure rates compared to traditional mechanical locking components. Specifically, electronic components are often sensitive to environmental conditions, such as heat and moisture, resulting in functional degradation or complete breakdown of the components if exposed to these elements. Electronic components (such as signal receiver chips and electronic keypads) are also significantly less robust than mechanical components (such as combination wheels and keypads) to externally applied physical forces, and are therefore more vulnerable to vandalism when these components are exposed to an external surface of the lock. Furthermore, most modern electronic components have a short average lifespan resulting in the eventual failure of the components even if they are operated in ideal environmental conditions and are protected against vandalism. When the electronic locking components of a conventional smart lock (e.g., an electronic keypad as the interface) fail, there is typically no way for the user to open the lock from a closed state without compromising the integrity of the lock (e.g., by destroying part of the lock). As a consequence, a user who is otherwise authorised permitted to open the lock is prevented from doing so until the locking components are repaired.

Furthermore, the need to carry an access tool or device to operate the lock is often inconvenient for the end-user. For example, it may be desirable to use a smart lock in a locker facility installed at playgrounds or on the beach. In such applications, users are likely to store their mobile phones and other devices inside the locker rendering the access device unavailable for use as an operational tool for the lock. In these applications, it may also be impractical for users of the locker facility to carry around a device, such as a FOB or key card, to be able to lock or unlock the locker, where needed.

The aforementioned existing smart lock systems may also have economic disadvantages. Specifically, the requirement of a specialised tool or device to operate the lock adds to the complexity and cost of system administration. That is, the external access devices (e.g. the FOBs, RFID bands or key cards) must be produced and programmed at a cost to the system administrator. The administration of electrical access devices can be cumbersome for facility providers in which the locks may be deployed. Furthermore, facility access management for new end-users, especially for ones who need instant or one-off access, can be difficult and expensive under such systems.

Some existing smart lock systems utilise smart phone-based access methods. However, these types of smart lock are not suited to all end-users. For example, users who are not IT or computer savvy may not possess the ability to configure a smart phone, and/or its associated applications, to interface with the smart lock system. More significantly, users without any access to a smart phone device (e.g. school children) would be unable to operate the lock, and would therefore be prevented from using the facilities on which the locks are deployed (e.g. school gym lockers).

Traditional mechanical locks avoid some of the disadvantages of conventional smart locks via the use of mechanical locking components, such that the user interacts with the locking components manually in order to authenticate themselves (i.e. by manipulating the locking components into a specific unlocking configuration, such as for combination wheel components), and, if successful, cause the lock to transition to an open state. While mechanical locks are more durable, and are generally more robust to harsh environmental conditions, than conventional electronic smart locks, they lack the flexibility and customisation which can be provided to users by smart locks.

Specifically, traditional mechanical locks have locking components that are capable of maintaining only a small number of unlocking configurations (i.e. typically one). As such, multiple users cannot be provided with permission to open the lock without exposing the unlocking configuration to each user who is so permitted at the present time. Furthermore, once a user is granted access to open the lock revocation of their access requires recalibrating the locking components, and redistributing unlocking configurations to all other users who are still permitted to open the lock. This is time-consuming, costly, and may not be possible for some types of traditional mechanical locks without replacing the lock entirely.

The described embodiments of the present invention include a smart lock system and process which permits control to be exercised over the unlocking configurations of a smart lock via communication between the smart lock and a lock management system. Specifically, the smart lock has one or more mechanical locking components having a configuration that is determined by the physical manipulation of the components (such as, for example, a set of combination "wheels", "reels" or "dials"). The unlocking configurations correspond to respective unlock input combinations of the mechanical combination wheels which are associated with an unlocked state of the lock, and which are maintained by an electronic controller. The controller includes a microcontroller that is configured to identify a presently selected configuration of the locking components (corresponding to a particular input combination), and compare the selected configuration with the stored unlock input combinations to determine whether to open the smart lock. The integration of mechanical combination reels, which provide a simple, familiar and robust mechanical interface to the user, with electronic components, which control the operation of the lock and its communication with the management system, allows the proposed smart lock system and process to achieve significant advantages over conventional smart lock technologies, as illustrated herein below.

That is, the smart lock described herein includes one or more fastening components that are controlled by the microcontroller which acts as a relay configured to cause a locking means to move between a first position in which the lock is placed in a locking state, and a second position in which the lock is placed in an unlocked state. The locking means can include a fastener which is moved by the fastening components into the second position when the locking components are in any one of the unlock input combinations (i.e. when the mechanical reels are configured with an input combination that matches any one of the stored unlock input combinations). The functionality of the smart lock is customisable by the lock management system, which transmits lock configuration data to the smart lock indicating the unlock input combinations of the lock. A communications module of the lock enables the wireless transmission of data between the smart lock and the lock management system. The lock management system includes a lock management device executing a lock management application which allows an administrator of the lock (e.g. the lock owner) to: register the lock with their application account; manage access to the lock by modifying the unlock input combinations stored within the microcontroller; and receive update data from the smart lock indicating status and operational information of the lock.

In the described embodiments, the smart lock is a combination based lock such that the locking components include one or more mechanical combination wheels, where each wheel has a plurality of elements, one of which being an 'active' element for the locking component at any one particular time. A user of the smart lock sets the current configuration of the locking components (referred to as the "selected configuration") by manually manipulating the components, which in the described embodiments involves rotating one or more of the combination wheels such as to change the respective active elements, and the display of a corresponding symbol, such as a digit, that is selected on the wheel for the particular active element. For example, a combination smart lock may have three combination wheels, each with elements represented by digits from 0 to 9. As a result, there are 1000 unique configurations of the locking components, and the user can rotate each of the combination wheels to change the selected symbol (and the corresponding the active element) and therefore attempt to produce a selected configuration of the locking components that will open the lock (i.e. that will match to an unlock input combination).

The active element of each combination wheel is determined by electronic detection circuitry. In some embodiments, the detection circuitry of the smart lock is based on the electrical properties of the elements. For example, each element can be configured to possess an electrical resistance that is unique among all other elements of the particular combination wheel. The active element of each combination wheel locking component is indicated to the microcontroller by a series of selection bits which are output by the detection circuitry and are subsequently input into the microcontroller (i.e. as represented by the input signals). The microcontroller processes the selection bits for each respective locking component to determine whether the locking components are collectively arranged according a configuration (the "selected configuration") that matches to an unlock input combination, and if so generates fastening control signals to cause the lock to open.

In other embodiments, the detection circuitry includes an optical detection system in which the active element is determined based on the generation and detection of a light beam by optical emitter and sensor components. The emitter and sensor components may be provided in a single module, such as an opto-isolator module (referred to as an "optical module"). For example, in one embodiment the emitter and sensor of the optical module are configured such that the light beam emitted between these components is interrupted by tabs of a disc corresponding to the combination reel, where the disc is configured to rotate mutually with the reel (i.e. as the reel is manipulated by a user during the selection of the active element). Rotation of the reel results in the periodic interruption of the light beam due to the corresponding rotation of the disc, which causes an optical signal to be generated by the module. The optical signal is processed by components of the detection circuitry (e.g. an encoder) to determine the active element of the reel (e.g. by counting the number of pulses in the signal, each corresponding to the passing of a disc tab through the beam, as described below).

Although the embodiments described herein determine the active element of a reel based on either electrical resistance or optical sensing, the skilled addressee will appreciate that the detection circuitry may be modified to use other types of sensing to determine the active element. For example, the smart lock may be configured to utilise magnetic sensing to determine the active element of each reel. In such embodiments, electronic signals are generated based on the determined magnitude (i.e. "strength") of a magnetic field produced by each reel, where the strength of the magnetic field varies according to the active element of the reel.

It will be recognised that the detection circuitry implemented within the smart lock need not be limited to the above described electrical resistance, optical sensing and magnetic sensing mechanisms. The specific detection circuitry implemented within the smart lock may vary based on factors such as, for example, the environments in which the lock is to be deployed and its corresponding functional requirements (e.g. water and corrosion resistance, mechanical longevity against frequent use, etc.).

In the described embodiments, a user physically interacts with the combination wheel locking components in order to open the smart lock. The microcontroller, and other electronic components, are enclosed within a housing of a body of the smart lock, such that the electronic components are externally inaccessible. Interaction between the user and the locking components occurs via a locking interface, such as a combination lock panel in the described embodiments, which allows the user to rotate each combination wheel in order to change the active element of the wheel. The selected symbol corresponding to the active element for each locking component is indicated visually on the locking interface, such as for example by an indentation or marketing that is aligned with the locking component. In some embodiments, the smart lock includes an antenna, or other signal amplification device, connected to the communications module in order to facilitate communication with the lock management system. The antenna can be configured to, at least partially, protrude through the housing in some embodiments.

The microcontroller is configured receive input signals which indicate the active element of each locking component, and therefore allows the microcontroller to determine whether the selected configuration of the locking components corresponds to an unlock input combination effective to open the lock. The input signals can be received from detection circuitry configured to detect the active element of each locking component, and to provide a corresponding representation of the active elements to the microcontroller. The microcontroller is configured to output fastener control signals which control the fastener. For example, when the smart lock is a padlock the fastener may be a U-shaped bar (a "u-bar") which has a locked position forming a closed connection at both ends with the body of the smart lock. Alternatively, when the smart lock is a door lock the fastener may be a bar of a substantially straight shape that has a locked position such that the bar extends into the frame of the door to secure the door with a corresponding frame. In some embodiments, the transition of the fastener from the locked to unlocked positions is performed by one or more fastening components, such as an actuator, latch or other mechanical or electromechanical device, which is activated in response to the control signals generated by the microcontroller.

Communication between the lock management system and the smart lock occurs via one or more wireless communication networks. In the embodiments described herein, the communications module is adapted to receive lock configuration data from the lock management device in the form of data transferred over a telecommunications network, and specifically via an SMS message. However, it will be appreciated that in other embodiments, the communication module may be configured to enable wireless communication between the smart lock and the lock management system using other wireless networking technologies (e.g. via messages that are represented via data packets delivered using the WiFi IEEE 802.11xx standard).

The lock configuration data can represent a request to modify the set of unlock input combinations presently maintained by the microcontroller such as to add or remove a specified combination. The locking configuration data is processed by the microcontroller to convert a high-level expression of the particular specified combination into a corresponding low-level representation for storage in, or removal from, a memory of the microcontroller. For example, the lock configuration data may indicate that the symbol sequence "123" corresponds to an unlock input combination of the smart lock, when this sequence is reproduced on the locking interface (i.e. via the manipulation of the locking component combination wheels). The microcontroller processes the high-level symbol representation (i.e. "123") to produce a bit sequence corresponding to the active elements when the symbols are produced by the locking components, and stores the bit representation in local memory.

In other embodiments, the smart lock is configured to generate lock configuration data locally via the operation of the microcontroller (i.e., without receiving data from an associated lock management device). In such embodiments, the one or more unlock input combinations of the smart lock are determined via an unlock combination generation process executed by the microcontroller. For example, the microcontroller can be configured to generate one or more unlock input combinations according to a One Time Passcode (OTP) generation process. The generation of OTP combinations can be performed in response to a particular user interaction with the smart lock, such as for example the actuation or selection of a "OTP Generation" button or control that is active when the lock is in an unlocked state. This allows the smart lock to be operated by a user in an ad hoc manner without the requirement of real-time data exchange between the lock and an associated lock management device (i.e., without the generation of pre-determined unlock configurations by a management device, and the subsequent transmission of the pre-determined configurations to the lock).

The lock configuration data may contain additional information representing particular conditions for which the indicated unlock input combinations are effective to open the smart lock. The lock configuration data can specify a start time and a duration for the unlock input combination, such that the smart lock can be opened when the selected configuration matches to the specified unlock input combination only within the specified time interval (referred to herein as an "access interval"). In the described embodiments, the lock configuration data is generated by the lock management application which is configured to determine the relevant access interval from the condition data associated with a specified combination, and to perform scheduling functions involving the automatic transmission of an SMS message to the smart lock to request the addition or removal of the specified combination at the start time, and a subsequent SMS message requesting the inverse operation after the expiry of the access interval.

In embodiments where the smart lock is configured to generate lock configuration data locally, the unlock input combinations that are determined by the lock itself (i.e., according to the unlock combination generation process of the microcontroller) may have a predetermined, or "default", access interval. For example, an OTP generation process executed by the microcontroller may be configured to produce one or more combinations that are effective to open the smart lock for a predetermined or user selectable time period following their generation (e.g., 1 hour). This allows for the smart lock to be operated by multiple users in applications where time-dependent ad hoc sharing of the lock is required (e.g., for a gym or sports facility locker, where multiple individuals utilise the lock to secure their belongings for a fixed short duration of time).

In the described embodiments, the smart lock microcontroller is configured to transmit lock update data to the lock management device via the communications module. The lock update data can include lock status data, such as the present state of the lock (i.e. closed or open) and an indication of the date-time-location at which the transition to this state occurred. To obtain the location information, the microcontroller is configured to include, or interface with, a GPS module. The lock update data can also include operational data such as an indication of the power remaining in the battery, and an indication of the unlock input combinations currently stored by the microcontroller of the smart lock. Transmission of the lock update data occurs in the form of an SMS message. The microcontroller is configured to store an indication of the lock management device, such as a corresponding mobile phone number when the device is a mobile phone.

In embodiments where the smart lock is configured to generate lock configuration data locally (e.g., via an OTP process), the lock operational data can include lock synchronisation data. The lock synchronisation data allows for the synchronisation of the unlock combination generation process of the smart lock with a corresponding process of the lock management device. For example, the lock synchronisation data can include an indication of the OTP generation algorithm utilised by the microcontroller, and/or specific data used by the algorithm to produce the OTP combinations (e.g., the numerical seed of the PRN sequence generator instance).

The management application of the lock management device is configured to process the lock synchronisation data in order to enable a corresponding unlock combination generation process of the application to produce the same unlock combinations as the smart lock. The management application can be configured to transmit lock configuration data, including the generated unlock input combinations, to a user device of a user of the smart lock. The ability to generate synchronised unlock combinations, using either the local functionality of the lock itself (e.g., an OTP generation button) or the lock management device application, facilitates ad-hoc shared use of the smart lock by allowing for the dynamic generation of unlock input combinations in situations where real-time data exchange between the management device and the lock cannot be guaranteed.

The lock management system includes a least one lock management device, such as a computing device configured to execute the lock management application. In the described embodiments, the lock management device is a mobile computing device, such as a smart phone or tablet, and the lock management application is a mobile application in the form of a dedicated software program obtainable from a digital distribution platform that provides applications for an operating system executing on the device (e.g. Google Play Store or Apple Store). In other embodiments, the lock management application can be a generic software application, such as a web browser configured to render one or more webpages provided by a hosting device (such as a lock management web server) for the purpose of providing the smart lock management and control functions described herein.

Each lock management device is operated by an administrator who interacts with the lock management application for the purpose of remotely managing one or more smart locks that are registered to an application account of the administrator (referred to herein as "registered smart locks", and as being "registered to the administrator"). The lock management application can be configured to maintain data associated with the remote management of one or more smart locks locally on the lock management device (such as by using the internal storage components of the device). Alternatively, or in addition, data associated with the remote management of smart locks registered to the administrator can be linked to the administrator's application account, and maintained in association with this account on another device of the lock management system (such as, for example, within a remotely accessible application account server).

The lock management application is configured to allow the administrator to manage the unlocking functionality of each smart lock by requesting that specified combinations be added to, or removed from, the set of unlock input combinations of the smart lock (as described above). The lock management application maintains a representation of the unlock input combinations (e.g. a list of the corresponding symbol sequences of the combination wheels in the described embodiments) that are currently effective to open the smart lock, and any associated scheduling information (e.g. an indication of when the particular combination was set as an unlock input combination, and/or when the combination will be removed).

The lock management application includes a remote access management interface which allows the administrator to allocate particular users to the lock, and to assign particular combinations to each allocated user for the purpose of permitting the user to open the lock. The smart lock system is configured to notify the user in real time when the smart lock microcontroller is updated to store the assigned combination. Notification occurs by the transmission of an SMS notification message from the lock management device to a user device of the user. The SMS notification message can provide the user with an indication of the assigned combination and the conditions in which the combination can be used open the smart lock. The conditions may include, for example, that the assigned combination is an unlock input combination only during a particular access interval. This allows the administrator to control access to one or more smart locks remotely, since a registered user can be assigned a unique unlock input combination for a particular smart lock dynamically in real time, and for a particular predefined period of time, such that the permission of one particular user to open the lock can be modified without compromising the security of the unlock input combinations that are assigned to other users.

The lock management application includes a lock operation interface which allows the administrator to view status and/or operational information of the lock, where this information is based on data included within lock updates received from each registered smart lock (as described herein). The administrator can perform maintenance operations in respect of one or more registered smart locks based on the status information maintained by the lock management application. For example, the administrator can schedule a battery maintenance operation when the status information indicates that the amount of power remaining in the battery of the lock is low.

The lock management application can be configured to provide the administrator with an indication of the unlock input combinations presently set for each registered smart lock and the number of users allocated to each lock. Users can be allocated to, or deallocated from, one or more of the registered smart locks, and particular unlock input combinations can be assigned to, or removed from, one or more of these users based on the present, or historical, status and/or operation of the smart locks. The lock management application can be configured to provide lock status log information indicating state transitions of the lock (e.g., from the closed state to the open state) over a particular period of time. In some embodiments, the lock management application can be configured to correlate changes in the lock state with particular users that were allocated to the smart lock during the time period of interest This functionality could, for example, be used to assist the administrator with identifying fraudulent activity or instances where the lock is malfunctioning (e.g. where the fastener has been damaged).

Embodiments of a smart lock deployed within the smart lock system described herein include portable locks and door locks. Portable embodiments of the smart lock can include, a padlock with a shackle type fastener in the form of a u-bar. The u-bar is connected to the housing at each opposing end when in the locked position. The fastening components can be integrated mechanisms, such as rotary disks or tumblers, or modular components which engage the shackle to secure the lock in a closed state. The fastening components are controlled by one or more micro-actuators which receive control signals from the microcontroller (as described herein above). Applications of padlock type smart locks include gates and outdoor enclosures or storage facilities, particularly where multiple users require individualised access to the facility. For example, these locks could be employed by companies to control worker access to resource rooms, and/or by local council or similar organisations to manage access to sporting and recreational clubs, education and training centres etc.

Door locks can be integrated into a door, or other moving structure used to control access, or entry, to, an enclosed space, for the purpose of securing the door to a frame. In such embodiments, the fastening components of the smart lock are integrated or modular mechanisms configured to engage a bar which extends through fixtures in the locker door, and corresponding fixtures in the frame, when in the closed position. Motorised or electromagnetic components can be used to retract the bar, or extend the bar through the fixtures, when the lock is open and closed respectively. For example, a smart storage locker can include a smart lock system with a smart lock for securing individual lockers within a locker bank (e.g. as deployed at music festivals and/or other outdoor events), and a locker management system to collectively manage shared access to each locker. Other exemplary applications of the door lock involve controlling access to shared facilities, such as sporting and recreational facilities (e.g. sports pavilions and storage enclosures or compounds), shared-accommodation (e.g. Airbnb business), and public amenities being managed by local councils (e.g. toilets, and community halls or centres).

Some embodiments of the smart lock system and processes described herein therefore advantageously provide a platform for managing one or more smart locks that:

- provides a secure locking system by combining mechanical locking components to authenticate a user attempting to open the lock with electronic control of the locking components, such that wireless information exchanges do not need to be performed between a device of the user and a device controlling the lock during the authentication stage, which improves energy efficiency and portability;
- improves upon the durability of conventional smart locks by enclosing the electronic components within a housing block, such that physical interaction between the lock and the user is restricted to an interface to the mechanical locking components, the lock body, and (in some embodiments) the fastener, thereby protecting the electronic components from damage;

provides a mechanism for administrators to control the lock by modifying the specific configurations of the locking components (i.e. the input combinations) which are effective to open the smart lock, such that permission to open the lock can be granted to, or revoked from, one or more users dynamically, and where the modification to the permission of a specific user to open the lock does not affect the other users;

allows seamless management of smart locks via the use of a lock management application that is configured to execute on a mobile device of an administrator;

provides a locking device that exists as a complete and stand-alone unit that is driven by its own internal power supply, and which can operate autonomously in accordance with configuration information received via communication with the management system; and allows the transmission of lock configuration and update data over wireless networks, including telecommunications networks which can offer improved security and robustness compared to conventional Internet-based networks.

System

Exemplary embodiments of the smart lock system and process are described herein below. As shown in FIG. 1, the smart lock system 100 includes a smart lock 120 in communication with a lock management system 130 via a communications network 118. In the described embodiments, the communications network 118 is a telecommunications network configured to exchange data between one or more devices via the Global System for Mobile communications (GSM) protocol or similar protocols. For example, the network 118 may be a third generation (3G) GSM network configured to transport data via EDGE or EGPRS according to UMTS standards, or a fourth-generation (4G) network implemented according to LTE advanced standards. In other embodiments, the network 118 may include one or more other types of wireless communication networks, such as a WLAN, WPAN, an adhoc network or any other type of wide area network facilitating the exchange of data between remotely located electronic devices.

The smart lock 120 includes: a body 104 consisting, at least partially, of a housing configured to house internal components of the smart lock 120; a fastener 106 connected to the body 104, the fastener 106 being configured to be in either: a locked position such that the smart lock 120 is in a closed state; or an unlocked position such that the smart lock 120 is in an open state.

Body 104 is formed from a rigid material, such as a durable plastic or metal, into a shape such that the housing of the body 104 conceals the internal components and substantially prevents physical access to these components. Fastener 106 is connected to the body 104 in a manner determined by the embodiment of the smart lock 120. That is, the fastener 106 and body 104 collectively operate to enable the smart lock to fix two or more objects together by preventing the separation of these objects, when the fastener 106 is in the locked position.

For example, when the smart lock 120 is a padlock the fastener 106 may be a U-shaped bar that is connected to the body 104 at both ends such as to trap the objects between the fastener 106 and the body 104. When the smart lock 120 is a door lock, such as for example that used within a smart locker, the fastener 106 may be a bar having a substantially flat or straight shape (a "straight bar") that is connected to the body 104 at one end, and configured such that the opposing end is in a position preventing a door, to which body 104 is attached, from moving out of the plane of a corresponding door frame. In both embodiments, fastener 106 and body 104 are formed from a rigid material which is resistant to the application of an external force (such as a shearing or compressive force) to cause a separation of the objects from the fastener 106 and/or the body 104 when the smart lock is in a closed state.

Internal components of the smart lock 120 include: a microcontroller 112; one or more fastening components 108 connected to the microcontroller 112 and to the fastener 106, where the fastening components 108 are configured to move the fastener 106 from the locked position to the unlocked position; one or more locking components 110; a communications module configured to communicate with a lock management device via communications network 118; and a power source including a battery 116 configured to power, at least, the microcontroller and the communication is module. In other embodiments, the power source may power the components of the lock 120 without accumulating electrical charge in a battery (e.g. by utilising a power generating means that is connected to the components directly, such as one or more solar panels).

The fastening components 108 can include mechanical, electric, or electromechanical devices which enable the fastener 106 to transition from the locked position to the unlocked position. For example, for a padlock embodiment of the smart lock 120 the fastening components 108 may include a spring, latch, and actuation device. The spring can be located at a first end of the U-bar fastener 106, and can be configured to connect to the body 104 such as to exert a force onto the first end for the purpose of lifting the fastener 106 away from the body 104 and in a direction transverse to a surface of the body containing a first hole through which the first end of the fastener 106 extends into. The fastener 106 is configured with a groove or indentation near to a second end of the fastener. The second end is configured for insertion into a second hole in the surface of the body 104, such that the latch interacts with the groove, once the groove is passed into the second hole, to prevent the removal of the second end from the second hole of the body 104 when the fastener 106 is in the locked position. The actuation device can be a motor which operates to draw the latch into a recessed position out of contact with the groove, thereby releasing the fastener 106 and allowing the second end to move out of the second hole when the fastener 106 transitions from the locked position into the unlocked position. The operation of the fastening components 108 is controlled by the microcontroller 112 which is configured to generate fastening component control signals, such as for example a signal to operate the actuator to release the u-bar in the example described above.

The locking components 110 are a series of one or more combination wheels. The combination wheels each include elements represented by symbols in the form of a singular numerical digit between 0 and 9, each digit being displayed on the outer surface of the combination wheel according to a uniform and predetermined spacing. Each symbol is displayed with equal area on the outer surface of the combination wheel, such that a 360 degree rotation of the wheel around a central axis results in each symbol passing a particular fixed point adjacent to the surface of the combination wheel. The locking components 110 are collectively configured according to a selected configuration, where the selected configuration is one of a plurality of unique configurations of the locking components 110, and are associated with the activation of one or more elements of each respective component. For locking components in the form of combination wheels, each element is associated with a unique symbol of the wheel (i.e. with a particular digit), and the selected configuration therefore corresponds to a particular permutation of the digits associated with the activated element of each respective wheel.

For example, embodiments of the smart lock 120 can include locking components 110 consisting of three combination wheels W1, W2 and W3 respectively. Each locking component has elements E1-E10, where each element corresponds to a particular digit (e.g. '0' to E1, '1' to E2, . . . , '9' to E10) such that selection of a digit on a combination wheel component results in the activation of the corresponding element (e.g. selecting 0 on W1 results in the activation of E1 for W1). That is, the selected configuration is set by the selection of a digit on the combination wheel (i.e. by orienting the digit in a particular position as described below), and is associated with the activation of an corresponding element on each wheel W1-W3. The use of three combination wheels results in 1000 possible combinations with corresponding symbol sequences ranging from "000" to "999".

Active Element Detection

In some embodiments, each element possesses an electrical resistance value which is determined according to a resistance scale. The resistance values are chosen such that the detection circuitry is able to determine the active element on the application of a voltage to the element (as described below). In one configuration, the resistance values of each element are unique among all elements of the component.

For example, the resistance of element E1 corresponding to digit '0' is 1000 ohm, and the resistance value assigned to elements E2-E10 are multiples of the E1 value (i.e. E2=2×E1=2000 ohm, E3=3×E1=3000 ohm, . . . , E10=10×E1=10000 ohm). Activation of an element E1-E10 occurs when the wheel is rotated into a particular position which causes an electrical connection to be formed between the element and one or more detection circuitry components. The connection is formed by a corresponding electric selector switch S1-S3, which operates such that only a single element (i.e. the active element) of E1-E10 forms a closed circuit with the voltage source of the wheel component.

Figure 2A:
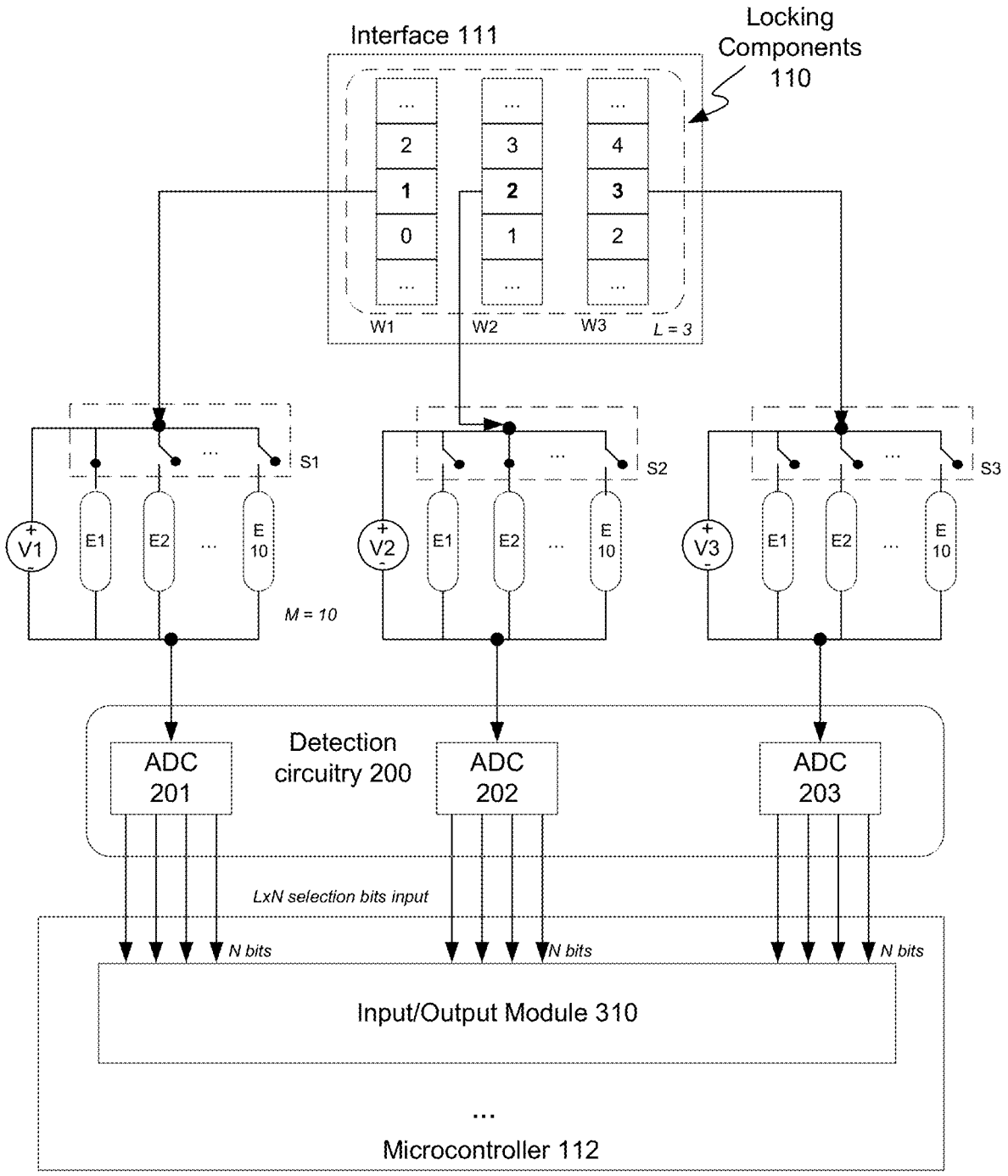
FIG. 2*a* is a block diagram of locking components and associated elements, detection circuitry and a microcontroller of a smart lock of the smart lock system.

As shown in FIG. 2*a*, in the described embodiments an electric switch selector element is used to modify the electrical connection between each element E1-E10 and corresponding components of detection circuitry 200. Each combination wheel W1-W3 is connected to a corresponding switch selector S1-S3 which connects the detection circuitry 200 to the activated one of elements E1-E10 (as described above), where the activated element corresponds to the digit that is selected on the respective combination wheel. Resistive elements E1-E10 are arranged in parallel with voltage sources V1-V3 corresponding to each component W1-W3, such that a closed electrical path is formed through the activated element of each respective locking component at any one time (i.e. since only one digit can be selected on the combination wheel resulting in the activation of only one of E1-E10). In the described embodiments, voltage sources V1-V3 are generated via the battery 116. However, in other embodiments voltages V1-V3 can be generated independently from battery 116 such that the locking components remain functional even in the event that the battery 116 fails (e.g. becomes depleted).

In the described embodiments, a locking component selection signal is generated in the form of a direct current that is generated in response to the application of a voltage to the active element. The resistance values of each element E1-E10 are chosen with sufficient variation such that the detection circuit can accurately detect each element E1-E10 based on the locking component selection signal in the presence of the applied voltage.

Figure 2B:
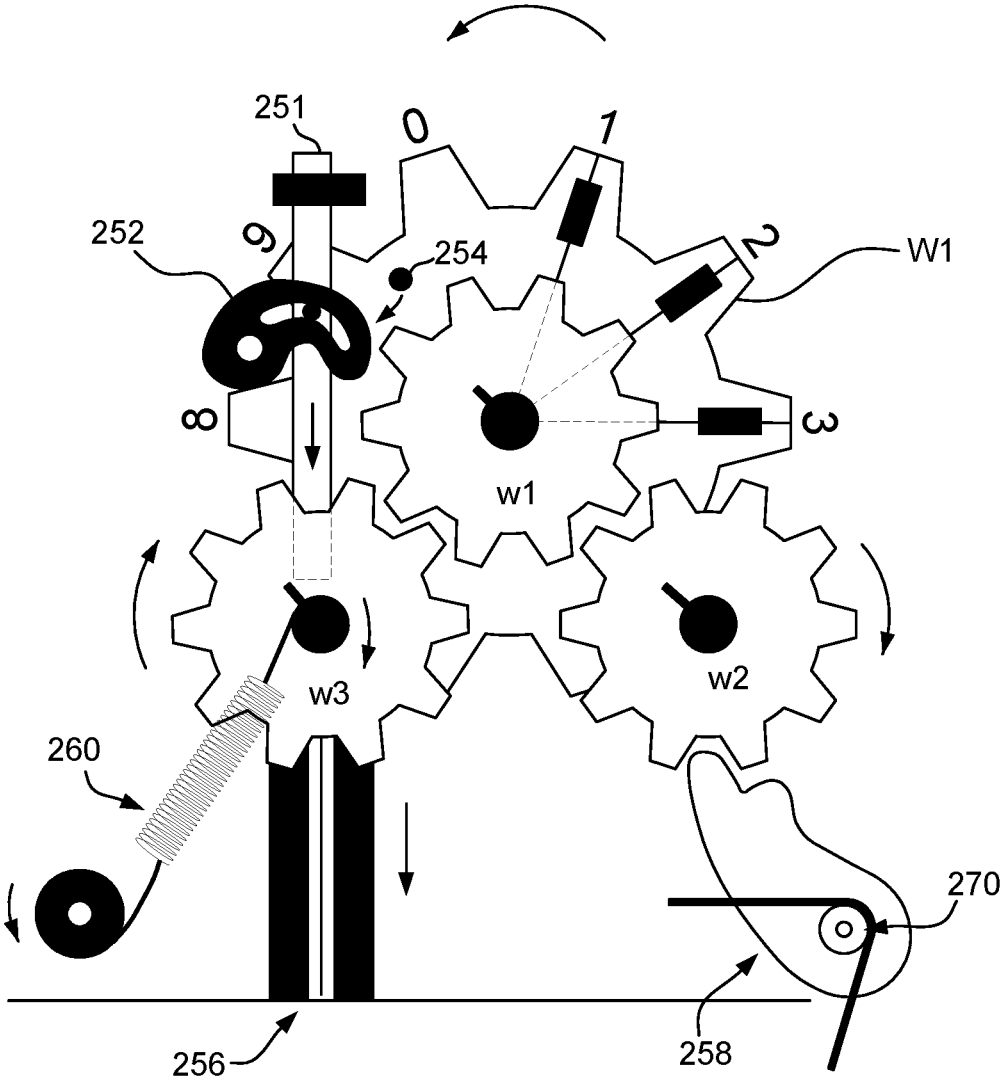
FIG. 2*b* is a schematic diagram of an exemplary configuration of a mechanical locking component of the smart lock.

FIG. 2*b* shows an exemplary implementation in which resistive elements E1-E10 are embedded within combination wheel W1 at physical positions corresponding to the symbol represented by the element. The selector switch S1 is implemented mechanically by a set of contacts which electrically connect an element of wheel W1 to a shaft when that element is moved into a particular position relative to the shaft (i.e. when the rotation of W1 causes the corresponding symbol to be selected, and the element to become active). In the implementation of FIG. 2*b*, the voltage V1 is applied between the active element of combination wheel w1 and the corresponding shaft of wheel W1 to generate the selection signal.

In some embodiments, the locking components are configured such as to implement a lock resetting mechanism which operates to reset the selected configuration of the lock 120 to a default unlocking combination when the fastener 106 moves into the unlocked position (i.e. as a result of the lock being opened). FIG. 2*b* illustrates a reset mechanism for combination wheel W1. In this implementation a user of the lock can only rotate wheel W1 in the counter-clockwise direction for the purpose of selecting an input symbol. The mechanism is implemented via gears w1, w2 and w3, which are connected to respective shafts with the shaft of gear w1 being the same as the shaft of wheel W1. The gears are arranged such that w1 is engaged with w2, and with w3 when bar 251 is in a raised position. As W1 (and therefore w1) is rotated, gear w3 rotates resulting in the extension of spring 260 and the creation of a corresponding tensile force within the spring 260.

The tension in spring 260 is released when wheel W1 experiences a full 360 degree rotation. Specifically, when wheel W1 rotates reaches its default position (i.e. the position in which default symbol '0' is selected), the pin 254 pushes down on a reset arm 252 causing bar 251, and the shaft of w3 to which the bar 251 is attached, to move vertically downwards through slider 256. As a result, bar 251 moves from the raised position to a depressed position causing gear w3 to be disengaged from w1. When this occurs, the force exerted by spring 260 causes gear w3 to rotate to a position such that spring 260 is no longer under a tensile load. Gear w3 remains in this position until pin 254 is no longer in contact with reset arm 252. When this occurs, gear w3 is re-engaged with gear w1. The result of this mechanism is that any rotation of less than 360 degrees of combination wheel W1 from the default symbol position will extend spring 260, due to the corresponding rotation of w3, and the tensile load is released once the wheel W1 experiences a 360 degree rotation.

The extension of spring 260 from its resting state results in a 'resetting' force being applied to actuate the shaft of gear w3, and to rotate gear w3 in the counter-clockwise direction. The rotation of w3, and consequently of w1, in response to the resetting force is prevented by the engagement of gear w1 with gear w2. Specifically, the counter-clockwise rotation of w3 (and clockwise rotation of w1) which would otherwise result from the resetting force is prevented by gear break 258, which stops gear w2 from rotating in the counter-clockwise direction.

When the fastener 106 moves into the unlocked position gear break 258 is configured to rotate downward and disengage from gear w2. Movement of the gear break 258 is caused by torsion spring 270 (as described below) such that gear w2 can rotate in the counter-clockwise direction when the gear break 258 disengaged from gear w2. As a result, while the gear break 258 is disengaged any resetting force applied to gear w3 (i.e. by spring 260) is effective to rotate gear w1, such as to cause wheel W1 to rotate clockwise back to its default position. In the described embodiments, spring 260 is a conventional compression spring. However, other embodiments may involve the use of a different type of spring, such as a torsion spring, and/or other biasing means to cause the desired rotation of gear w3.

Figure 2C:
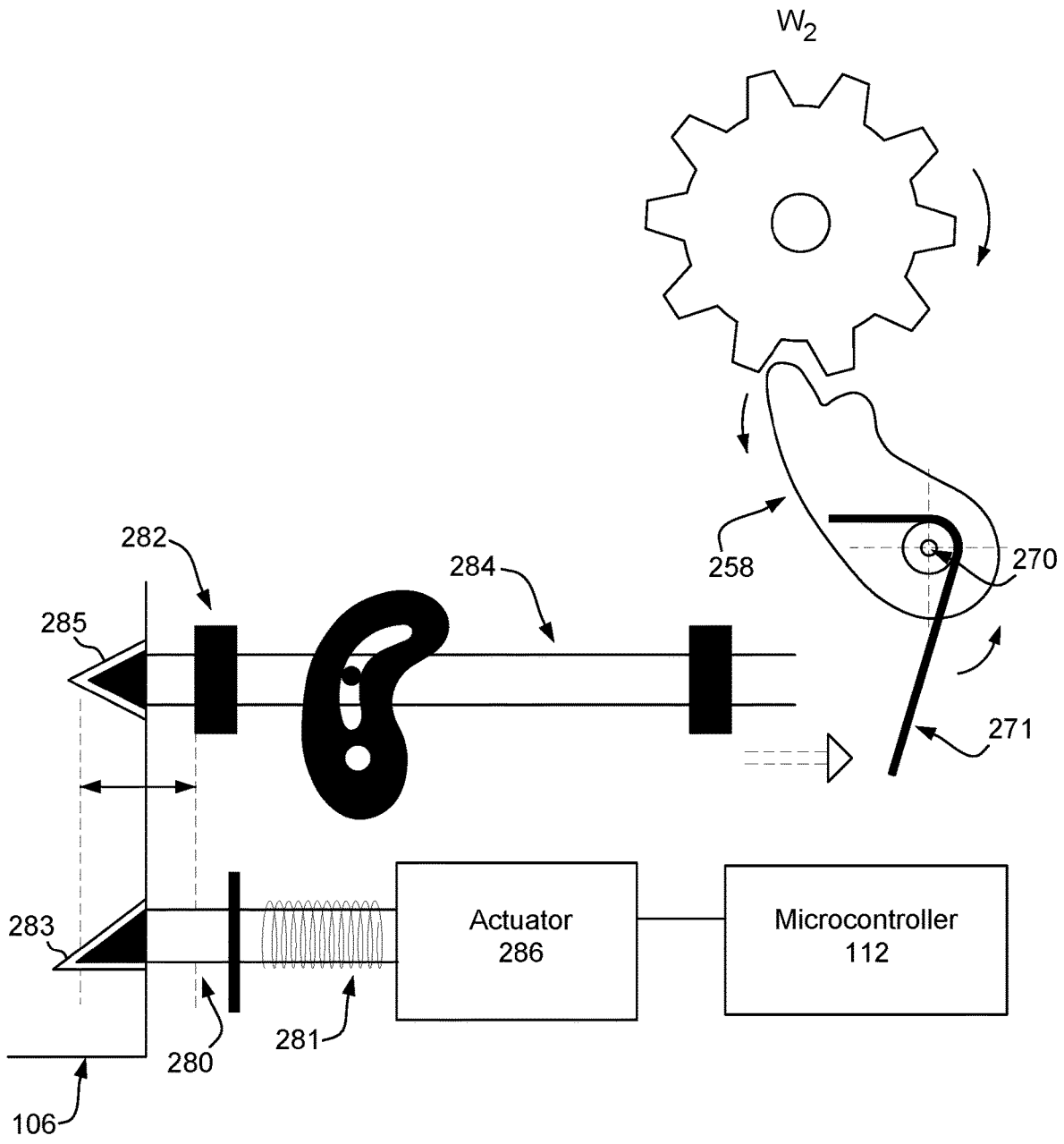
FIG. 2*c* is a further schematic diagram of the exemplary configuration of the mechanical locking component of the smart lock.

FIG. 2*c* illustrates the configuration of gear break 258 in a lock implementation including a fastener latch 280 and an auxiliary latch 282 connected to a bar-type fastener 106. Microcontroller 112 is configured to activate actuator 286 to cause fastener latch 280 to move out of corresponding groove 283 (i.e. into a recessed position). The actuator 286 can be implemented as an electromagnet which, when activated, results in a tensile force being applied to spring 281 as a result of the movement of fastener latch 280 out of groove 283. In other embodiments, other actuation devices, such as motors or levers, may be used as an alternative, or in addition to, an electromagnet. When latch 280 is moved out of groove 283, the fastener 106 is free to move into an unlocked position, which results in a tensile force being applied to torsion spring 270 by the bar 284, which is connected to auxiliary latch 282, when bar 284 contacts a lever 271 which is attached to spring 270. This occurs when the fastener 106 moves into the unlocked position, forcing latch 282 from corresponding groove 285 and moving bar 284 into contact with lever 271. The tensile force applied to spring 270 is effective to disengage the gear break 258 from gear w2 permitting the resetting of combination wheel W1, as described above.

The microcontroller 112 is configured to deactivate the actuator 286 after a predetermined period of time. Consequently, when the fastener 106 is moved back into the locked position, auxiliary latch 282 moves into groove 285 causing bar 284 to move out of contact with lever 271, resulting in the release of the tensile force from spring 270. As a result, gear break 258 re-engages with gear w2 preventing resetting of combination wheel W1 until the fastener 106 is again moved into the unlocked position. This configuration can be implemented in the context of any bar-type lock, such as a padlock or a door lock, where a transition between the locked and unlocked positions involves the movement of the bar fastener 106 in a direction transverse to the motion of the auxiliary and fastener latches.

A similar mechanism can be implemented for each of combination wheels W2 and W3, in order to cause these wheels to move to their respective default position (i.e. corresponding to symbol '0') when the lock fastener 106 moves into the unlocked position. The automatic rotation of each combination wheel W1-W3 to its respective default position corresponding to symbol '0' serves to reset the selected configuration of the lock to the default unlocking combination of '0','0','0' when the lock is opened.

In the above described embodiments, the detection circuitry 200 includes one or more analog to digital conversion (ADC) modules configured to detect the activated element for a respective combination wheel based on a selection signal input to the ADC module. The selection signal is in the form of a current signal obtained by measuring the current generated by the voltage source of the combination wheel (which varies based on the activated element E1-E10, as described above). Each ADC module generates an N-bit digital output signal in the form of selection bits representing the activated resistive element for a corresponding combination wheel locking component. In the described embodiments, there are M=10 selectable symbols and corresponding elements for each combination wheel locking component, such that N=4 selection bits are required to represent the activated element of (and therefore the symbol selected on) each combination wheel. In other embodiments, each combination wheel may have a different number M of selectable symbols, each corresponding to a different element E1-EM which is activated in response to the selection of the symbol on the wheel.

The ADC modules are configured to produce N=ceil($\log_2$ M) selection bits to indicate the selected symbol for a particular locking component (i.e., combination wheel). Each ADC module outputs a series of selection bits for each locking component for the microcontroller 112. For L=3 combination wheel locking components, L×N=12 total selection bits are generated by concatenating the N=4 bits produced by each ADC module 201-203. The selection 12 bits are input to the Input/Output (I/O) module 310 of microcontroller 112 to uniquely specify the selected configuration of locking components.

In some embodiments, the detection circuitry 200 includes a single ADC module which is configured to receive selection signals for each locking component, and to output a set of bits representing the concatenation of the individual selection bits for each locking component. This can be beneficial in smart lock embodiments where it is desirable to achieve a compact internal circuitry layout, such as to help minimise the overall form factor of the lock.

In some embodiments, the elements E1-EM of the combination wheels W1-WL can be connected directly to the microcontroller 112 via the I/O module 310. In such embodiments, the resistance values of each element E1-EM can be fixed uniform values, since the activation of a particular element will be indicated to the I/O module by the presence of a signal at the input corresponding to this element, and the absence of a signal for each other element.

In some embodiments, optical signals are used to detect the active element of each combination wheel. In one such configuration, the detection circuitry 200 includes one or more optical modules, in the form of a light emitter and a corresponding optical sensor. Each optical module is arranged relative to a disc D corresponding to a combination wheel W of the lock. Disc D includes M tabs which protrude radially from its centre, and is oriented within the lock such that the light beam of a corresponding optical module is interrupted by successive tabs of the disc as the disc rotates about a central shaft. The central shaft of disc D is rotatably connected to the corresponding combination wheel W, such that rotation of the wheel W resulting in a transition in the active element (e.g. from digit '0' to '1') results in a rotation of the disc, the rotation of the disc causing a predetermined number of tabs pass through the beam of the optical module.

In embodiments including combination wheels W1-W3, corresponding optical modules O1-O3 and discs D1-D3 are provided within the lock. Each optical module is configured to generate an optical signal representing the periodic interruption of its light beam as the corresponding disc (and therefore combination wheel) is rotated. The optical signal can be a rectangular pulse signal with high amplitude representing the presence of the beam (i.e. when the beam is aligned with a slot of the disc), and low amplitudes representing the absence of the beam (i.e. when the beam is aligned with a tab) at the detector of the module.

The optical signal generated by each optical module is transmitted to an encoder component of the detection circuitry. The encoder determines the active element of the wheel W by processing the optical signal over a period of time. For example, the encoder may be configured to maintain a counter value indicating the present active element of the wheel W based on the number of observed low to high amplitude transitions in the optical signal. The counter value may be incremented on the occurrence of a predetermined number of amplitude transitions, such that the encoder tracks the current active element of wheel W. Each encoder is configured to generate N selection bits to indicate the selected symbol for a particular locking component based on the maintained optical signal pulse count.

Figure 2D:
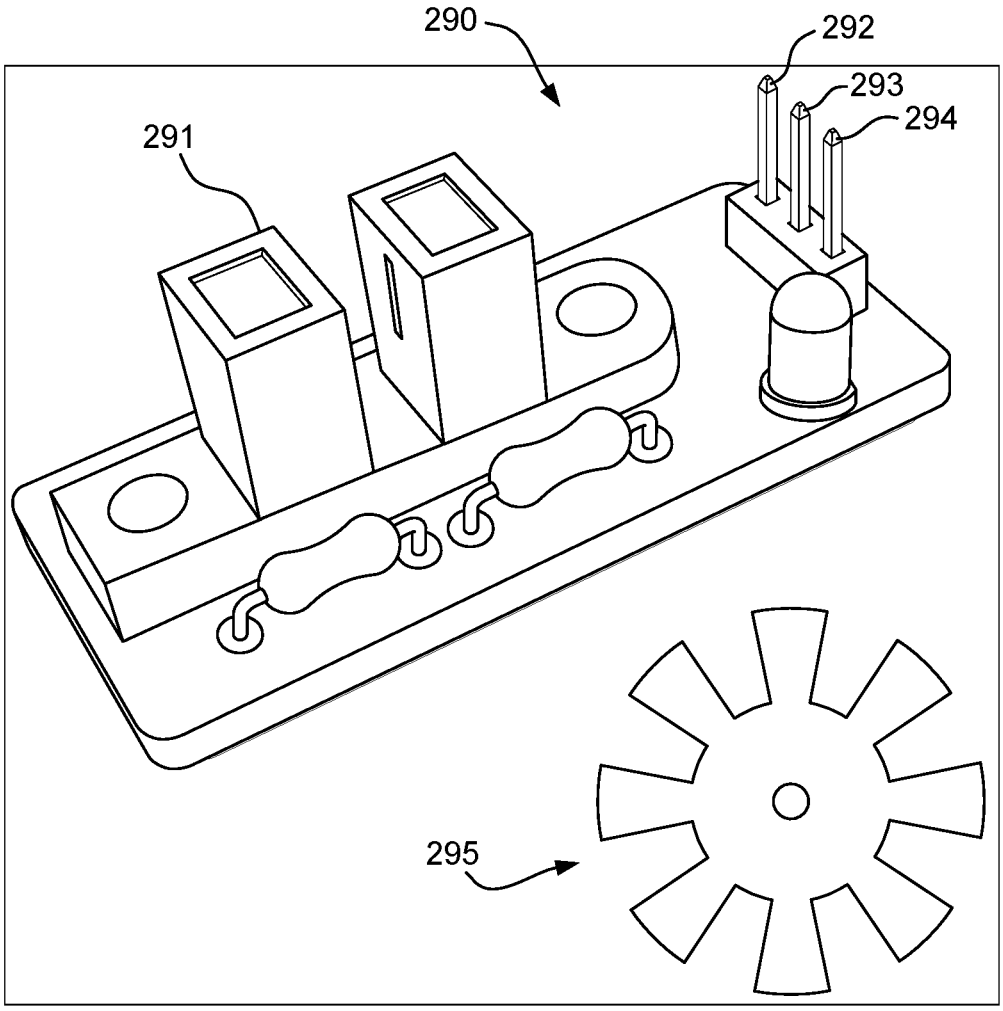
FIG. 2*d* is an illustration of an exemplary optical module of the smart lock.

FIG. 2*d* illustrates an exemplary optical module 290, in the form of an MOC7811 slotted Opto-isolator module, and a corresponding disc 295. The optical module 290 includes an IR transmitter (light emitter) and a photodiode (optical sensor) mounted on it. The disc 291 is oriented such that its tabs pass through the slotted space between the IR transmitter and photodiode. The transmitter and sensor pair 291 will detect the tab of the disc 295 when the disc rotates resulting in the generation of optical signal pulses. The header pin 292 is an input supply pin configured to receive a 5V (i.e. positive voltage) supply connection. The header pin at 293 is connected to a ground, or corresponding negative voltage supply. The header pin at 294 provides an output signal for the module. This pin is internally pull-up to 5V, thus no extra component is needed for this sensor to be connected to controller.

Figure 2E:
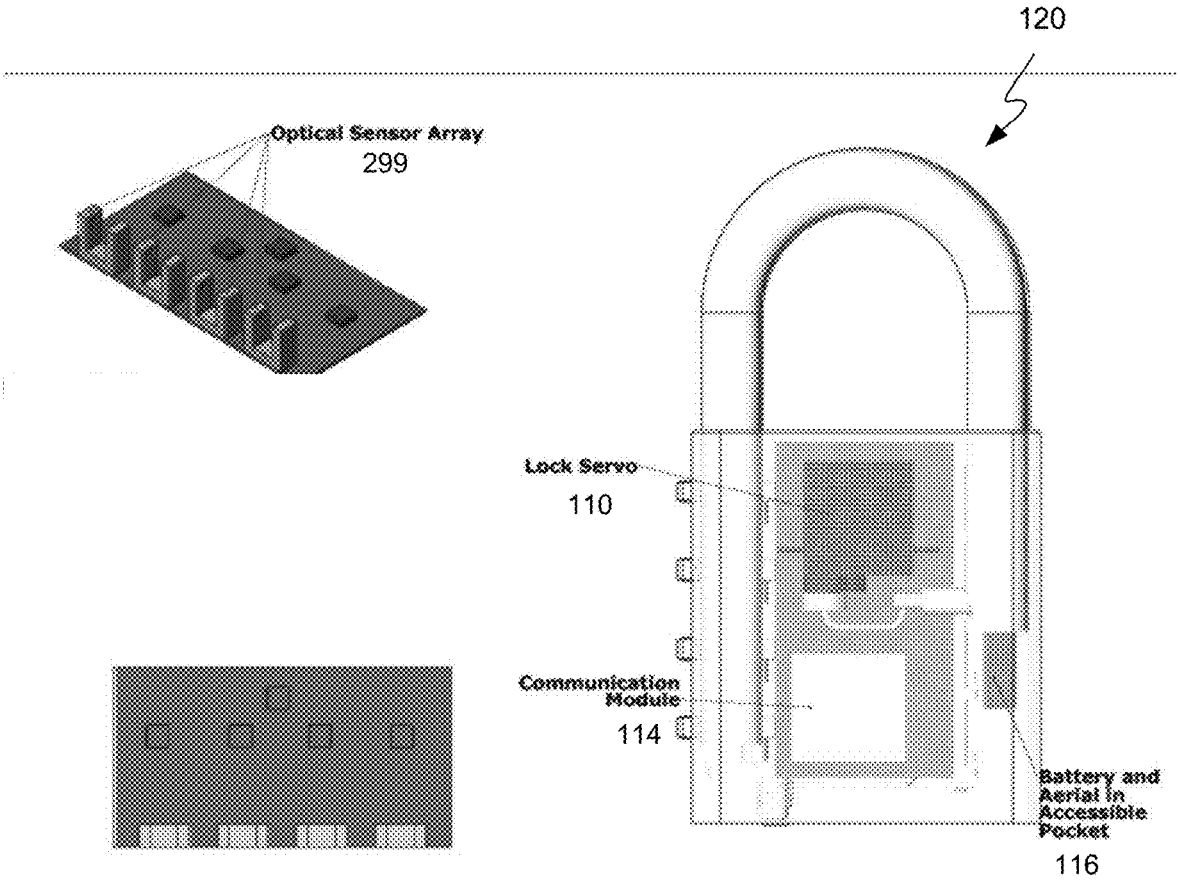
FIG. 2*e* is a schematic diagram of an exemplary internal organisation of a smart lock that implements optical signal based detection.
Figure 2F:
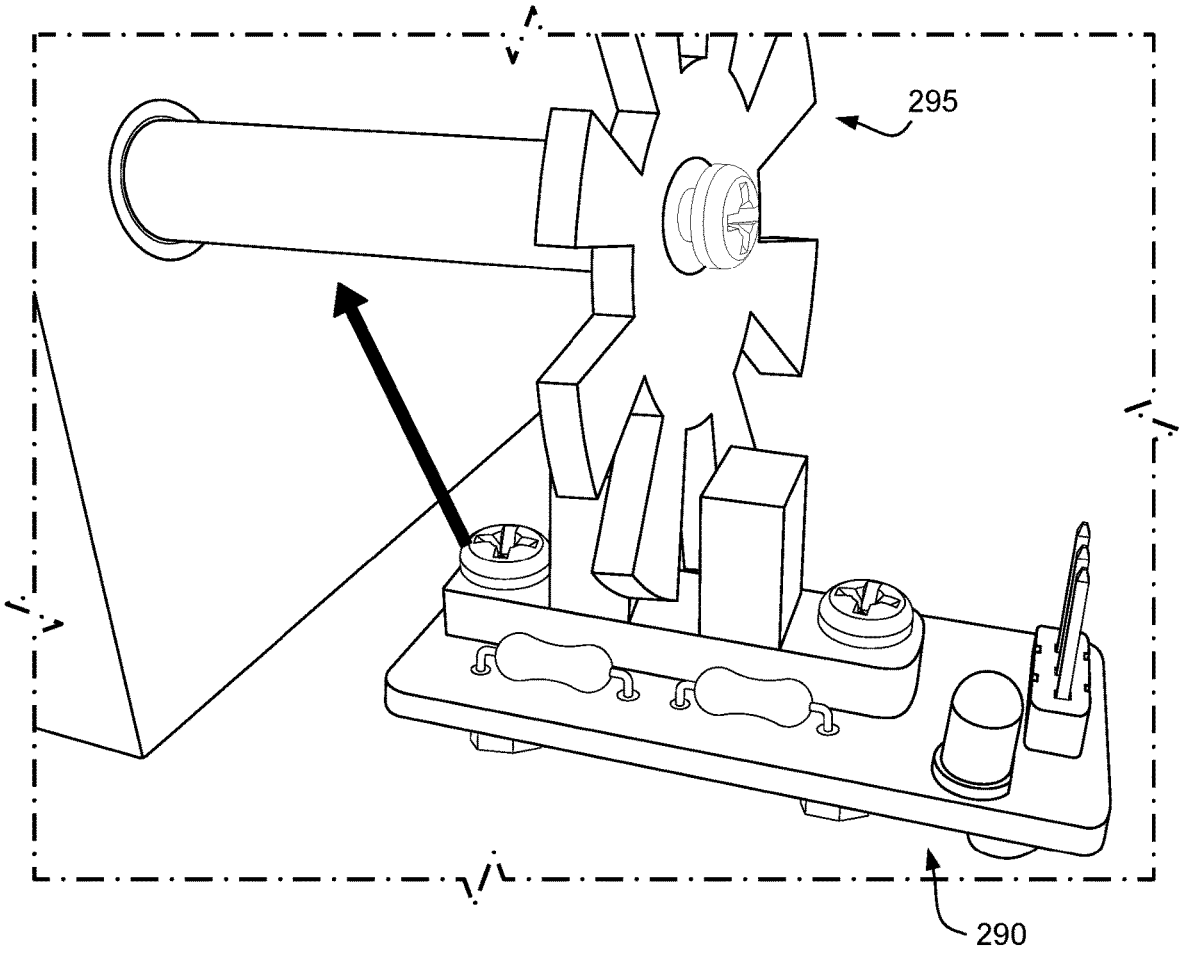
FIG. 2*f* is an illustration of a particular optical module and corresponding disc pair within a smart lock that implements optical signal based detection.

FIG. 2*e* illustrates an exemplary internal organisation of a smart lock that implements optical signal based detection of active lock elements via an array of optical modules (the "optical sensor array" 299). FIG. 2*f* illustrates a particular optical module 290 and corresponding disc 291 pair within such a smart lock. In embodiments using optical signal based detection, the rotation of the wheels is assessed from the default position (i.e. corresponding to digit "0"). A lock reset mechanism analogous to that described above may be implemented in the embodiments using optical signal based detection. When activated, the reset mechanism returns the selected element on each wheel W1-W3 to the default value (i.e. "0"), and also resets the counter value of the encoder for each wheel. In some embodiments, the reset mechanism is automatically activated prior to the first operation of the smart lock in order to ensure that the counter values maintained by the encoder components are synchronised with the actual active elements of the corresponding wheels.

In some embodiments, the lock reset mechanism is activated automatically if a predetermined period of time passes from the time when the encoder last incremented the counter value for at least one wheel. This prevents any non-default combinations (i.e. combinations that are not entirely comprised of the default element) from remaining on the lock interface for an extended period of time.

The selected configuration of the locking components 110 is set by manipulating one or more of the combination wheels via a locking interface 111 such as to activate particular elements for the respective combination wheels. As shown in FIG. 1, the locking interface 111 is a combination lock panel configured to visually indicate, at least, the selected symbol associated with the particular activated element of each combination wheel. The combination lock panel 111 is configured to allow a user of the lock to rotate one or more of the combination wheels in order to change the selected symbol (and corresponding activated element) of the respective wheel. The combination lock panel 111 can be implemented as a secure physical interface within the smart lock housing, such that only a portion of each combination wheel W1-WL is exposed (i.e. the portion corresponding to the currently selected digit), while the remainder of the combination wheel is concealed within the housing in a manner that prevents external physical access. User 101 interacts with each combination wheel via the combination lock panel 111 in order to rotate one or more of the wheels such as to select a particular symbol on the wheel (i.e. by moving the symbol to a selection position on the interface 111, as indicated by a marking or indentations on the panel 111).

Figure 2G:
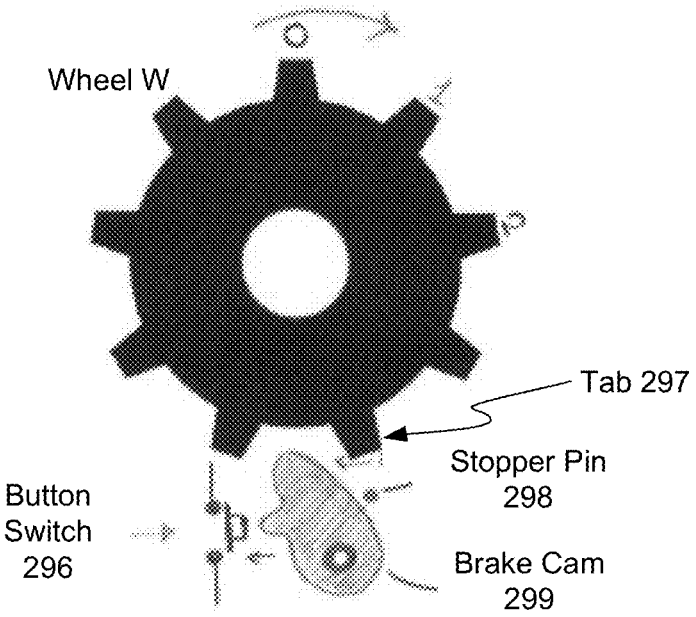
FIG. 2*g* is an illustration of a type of push-button detection mechanism for a combination wheel of the smart lock.

Other embodiments of the lock may implement alternative detection means to the electrical resistance and optical signal based detection methods described above. For example, detection of the active element for each wheel W can be achieved via an electric push-button switch. FIG. 2*g* illustrates an exemplary configuration involving this type of push-button detection, where the active element of the wheel W is determined by processing a detection signal formed by a series of presses (i.e. actuations) of a button switch 296 over a period of time. The button switch 296 is electrically connected to the microcontroller, and is actuated by a brake cam 299. The brake cam 299 is pivotally mounted to the body of the lock at one end, with an opposing end positioned to receive contact from respective tabs of the wheel W, as the wheel is manipulated by the user (i.e. rotated) during active element selection. On contact, a respective wheel tab 297 causes the brake cam to pivot forwards resulting in the activation of the button switch 296. Activation of the switch 296 causes the completion of an electrical circuit (as shown in FIG. 2*g*).

As the wheel W is rotated further, the tab 297 moves out of contact with the brake cam 299. The brake cam 299 is biased against the direction of movement of the tab 297, such that, in the absence of contact with the tab 297, the brake cam 299 pivots backwards breaking physical contact with the switch 296 (i.e. causing the switch to be deactivated), and coming to rest against a stopper pin 298. Deactivation of the switch 296 results in the breaking of an electrical circuit.

The result is a "press" of the switch 296 (i.e. an activation and corresponding deactivation) which causes the generation of an electrical pulse that is subsequently detected by the microcontroller. The brake cam 299 is positioned relative to the wheel W such that the actuation of the switch 296 by a single tab moving into and out of contact with the cam corresponds to a change in the active element of the wheel W. The microcontroller is configured to maintain a press count value representing the number of pulses generated from the actuation of switch 296, from an initialisation time, to determine the active element of the wheel W. For example, the presence of 6 pulses indicates that the switch has been actuated 6 times, corresponding to a movement of the wheel from a position where the active element is the initial element (i.e. symbol '0'), to a position where the active element is the sixth element of the wheel (i.e. symbol '6').

Each combination wheel W1-W3 has a corresponding button switch and brake cam, which are configured as described above. A lock reset mechanism, such as that described herein for embodiments using electrical resistance or optical signal based detection, can also be implemented with the press-button detection system. This mechanism resets the active element to the default element (e.g. symbol '0', as described above), and ensures that the pulse count maintained by the microcontroller is reset (i.e. the press count value is zeroed allowing the count to be restarted using the present time as the initialisation time), for each combination wheel W1-W3.

In other embodiments, detection of the active element for each wheel W can be achieved via magnetic sensing. FIG.

Figure 2H:
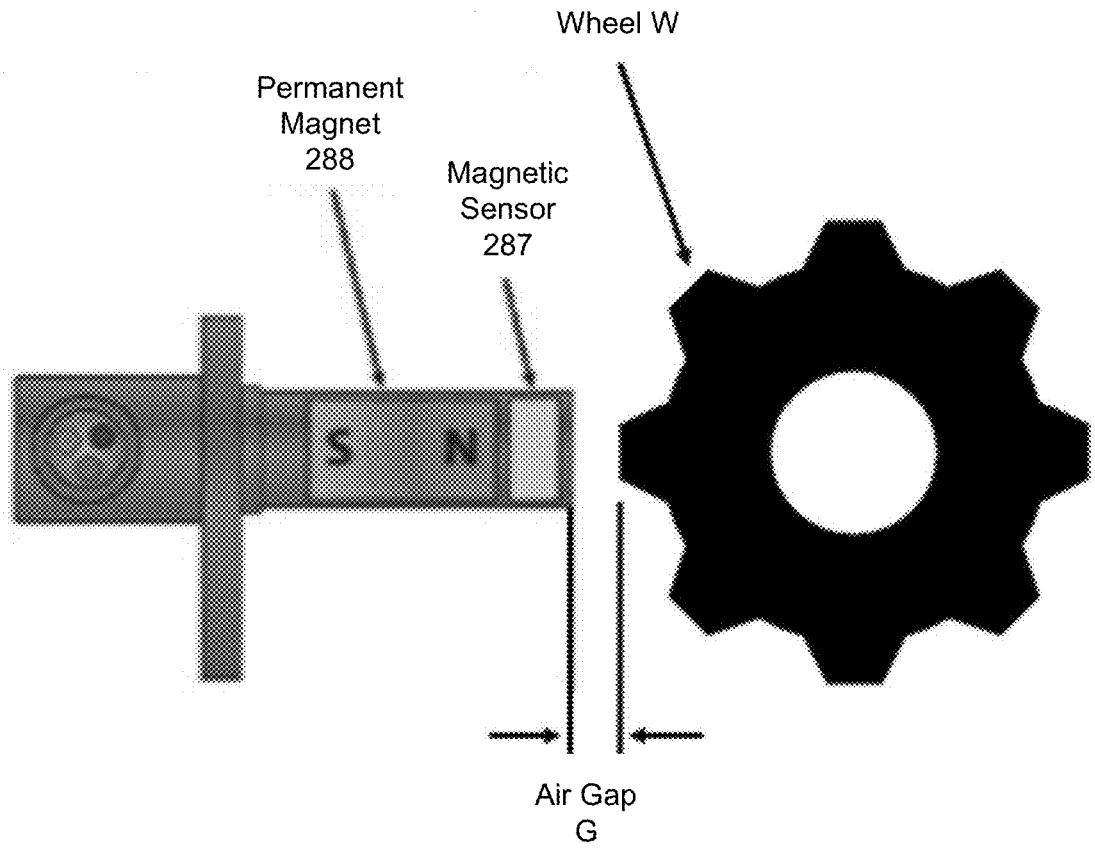
FIG. 2*h* is an illustration of a particular magnetic sensor and permanent magnet pair within a smart lock that implements magnetic field sensing based detection.

2*h* illustrates one such configuration, in which the detection circuitry 200 includes one or more pairs of a magnetic sensor 287 (such as a Hall Effect sensor) and a corresponding permanent magnet 288, the pair being arranged at a fixed position in the lock relative to a corresponding combination wheel W (e.g., separated from the wheel W by an air gap G, as shown in FIG. 2*h*). Wheel W is composed at least partially of a ferromagnetic material resulting in the generation of a magnetic field across the gap G. Electronic signals are generated by sensor 287 based on the determined magnitude (i.e. "strength") of the magnetic field produced by wheel W, as dependent on the active element (e.g., the portion of the wheel that is closest to the sensor 287 adjacent the gap G). The electronic signal can include an indication of an absolute value of, and/or a relative change in, the strength of the magnetic field generated by wheel W, such that processing of the signal by components of the detection circuitry 200 provides an indication of the active element (e.g. by counting the number of 'pulses' in the generated field strength signal, and/or by mapping a particular field strength value to a corresponding active element).

Microcontroller Operation

Figure 3A:
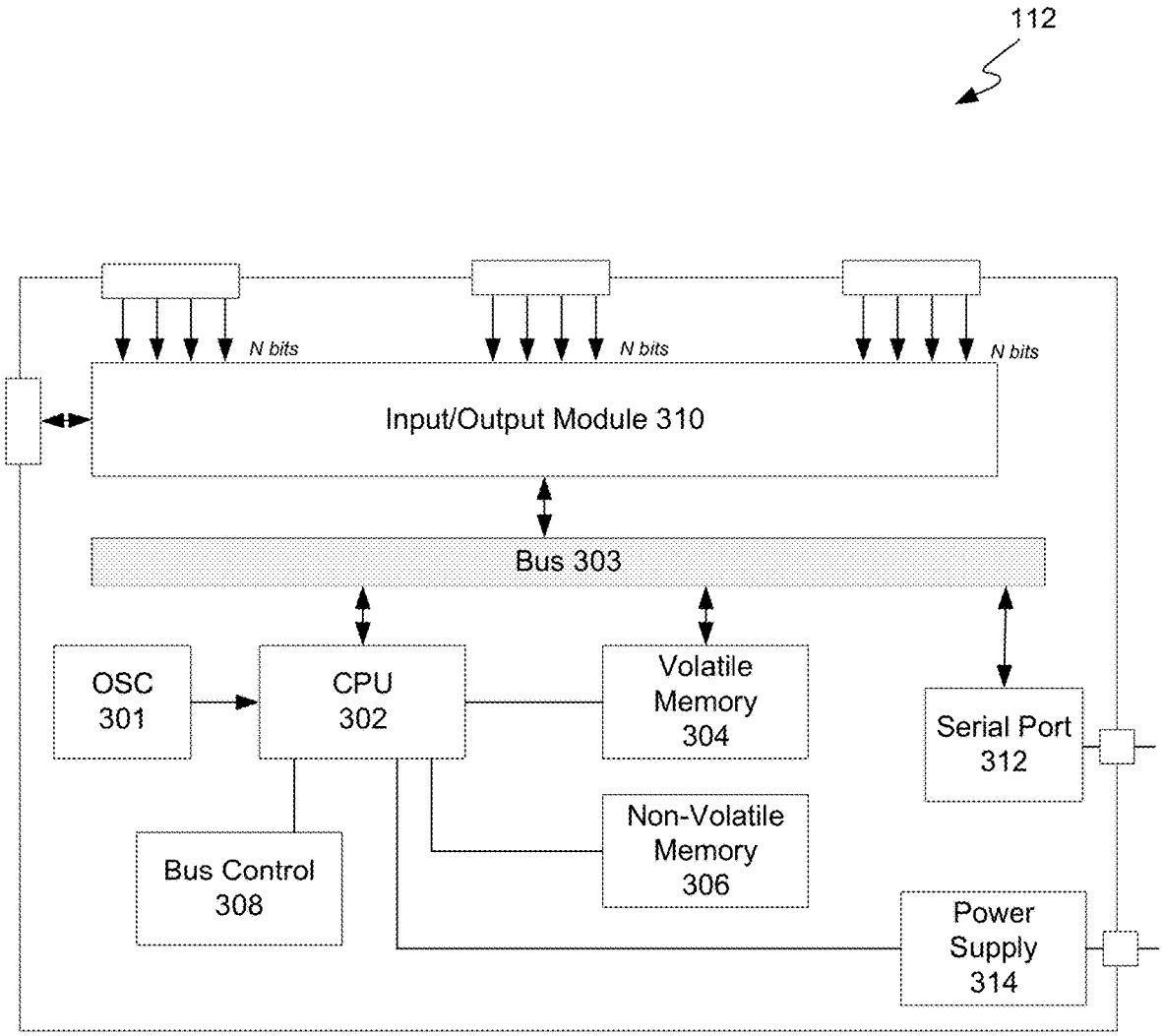
FIG. 3*a* is a block diagram of the microcontroller of the smart lock.

As shown in FIG. 3*a*, microcontroller 112 includes an oscillator 301 configured to generate a clocking signal for a CPU 302 which is connected to a bus 303. In the described embodiments, the CPU 302 is an ARM7TDMI® 16-bit/32-bit RISC machine which operates a bus control module 308 to control the exchange of data between the components of the microcontroller 112. Memory of the microcontroller 112 includes volatile memory 304, such as SRAM or flash storage, configured to operate on data received from a serial module 312 and/or the I/O module 310. Non-volatile memory module 316 is implemented as a ROM and stores instructions and data required for the operation of the microcontroller 112, including performing a comparison between the selected combination and one or more unlock input combinations to determine whether to open smart lock 120 when the lock is in a closed state (as described below). The CPU 302 views all memory and registers as a single linear array. Power supply module 314 provides power to the CPU 302, and other components of the microcontroller 112, via a connection to the battery 116.

Figure 6:
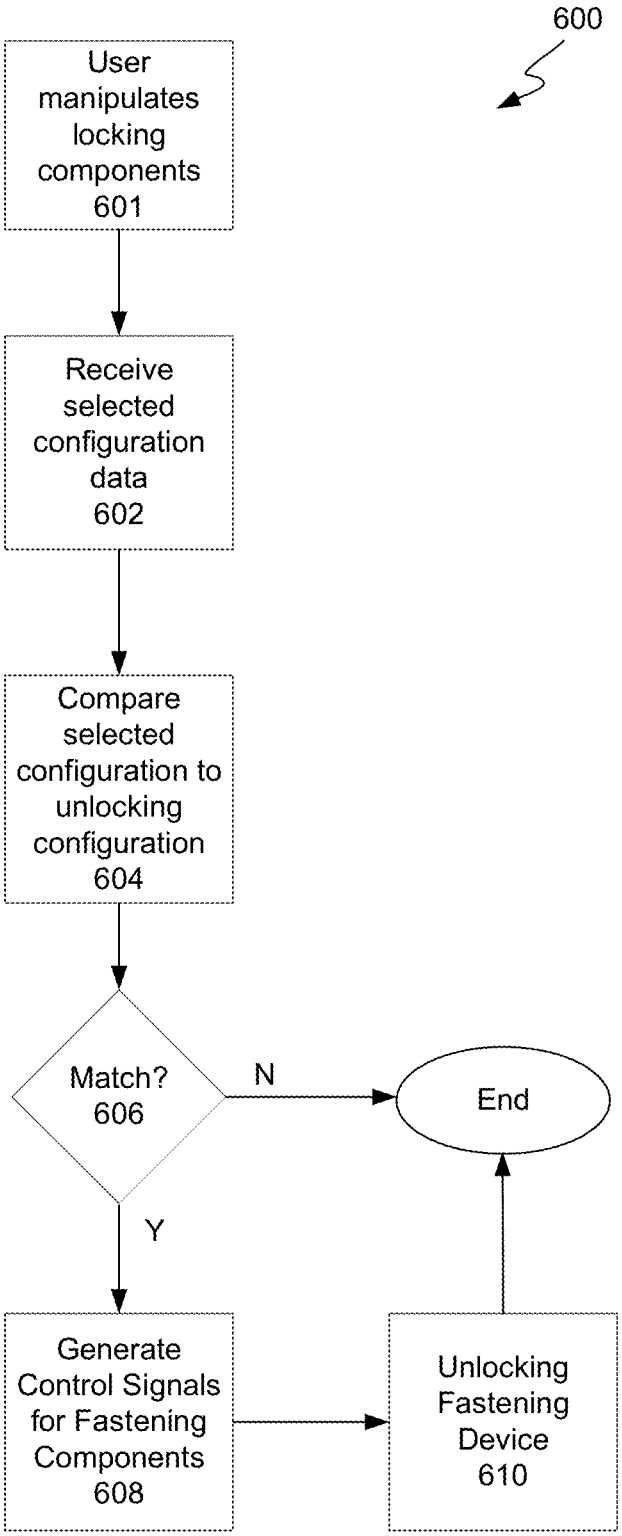
FIG. 6 is a flow diagram of a process for unlocking the smart lock for particular unlock input combinations of the smart lock in accordance with some embodiments of the present invention.

FIG. 6 illustrates a process 600 involving the operation of the microcontroller 112 to open the smart lock 120 from a closed state in response to a user 101 interacting with locking components 110. At step 601, the user 101 manipulates the locking components 110 via locking interface 111 to produce a selected configuration, as described above. At step 602, I/O module 310 is configured to receive L×N=12 selection bits as input representing the selected configuration of the combination wheel locking components. Non-volatile memory 306 is configured to store unlock input combination data representing one or more unlock input combinations of the smart lock 120.

In the described embodiments, the unlock input combination data represents each unlock input combination as the set of corresponding L×N selection bits. That is, the unlock input combination data encapsulates the low-level selection bit set that is produced by the detection circuitry (i.e. ADC modules 201-203 in the described embodiments) when the user 101 manipulates the combination wheels to produce the corresponding high-level symbol sequence (i.e. the unlocking 'combination', such as "123" in the above example) which is effective to open the lock. At step 604, the CPU 302 is configured to load the selection bits into memory 304, via bus 303, and to compare the selected configuration of the locking components 110 to data representing the one or more unlock input combinations.

If, at step 606, the selected configuration represented by the selection bit set matches to at least one unlock input combination as represented within the unlock input combination data, the CPU 302 fastener control signals to cause one or more fastening components to move the fastener 106 to a position such as to place the lock 120 in the unlocked state (i.e. at step 608). The fastening control signals are generated by the CPU 302 according to the specific fastening components 308 of the smart lock 120. For example, for a padlock embodiment with fastening components including a latch and actuator, the fastening control signals can include a signal transmitted to the actuator instructing the movement of the latch into the recessed position in order to release the fastener 106. In other embodiments, the fastening control signals can include more complex data and instructions, such as for example where the fastening components 108 consist of electromechanical devices configured to perform a series of operations to effect the transition of the fastener 106 into the unlocked position.

In some embodiments, the microcontroller 112 is configured to store a 'default selection configuration' being a configuration assumed by the locking components when the microcontroller 112 causes the one or more fastening components 108 to move the fastener 106 to a position such as to place the lock in the unlocked state. In such embodiments, the fastening components can include mechanical, electrical, or electromechanical devices, which operate to rotate the combination wheels W1-W3 of the described embodiments (or otherwise manipulate the locking components as required in other embodiments) to cause the selected configuration of the components to be the default configuration.

For example, with respect to the described combination wheel locking components W1-W3, the microcontroller 112 can be configured to generate reset control signals to operate a motor which causes the locking components to assume the default selection configuration in which the symbols on the wheels to show '0','0','0' (i.e. the default symbol sequence for the lock). The reset control signals can be generated immediately once the fastener moves into the unlocked position, or after a predetermined period of time passes after the fastener moves into the unlocked position. In other embodiments, the locking components can include mechanical devices, such as springs and gears, which are configured to cause the default selection configuration to be assumed automatically when the fastener moves into the unlocked position (i.e. as a result of a lock resetting mechanism, as described above). In embodiments using an optical module, the detector 200 is disabled during the movement of the fastener to reset the lock, and the counter value of the encoder is reset to indicate the default element (i.e. which is now the active element following the reset) as described above.

Microcontroller 112 exchanges data with the communications module 114, which is a GSM modem in the described embodiments, via the serial port 312. The GSM modem 114 is configured as a universal asynchronous receiver transmitter (UART) communications device which is configured to receive data in the form of SMS messages from the lock management system 130 via the communications network 118. The GSM modem 114 processes the received data as a sequential bit stream to extract the lock configuration data (as described herein below). In the described embodiments, the serial port 312 is configured to exchange data with the GSM modem 114 using half duplex transmission. The communication occurs using 8 data bits, no parity bits, and a single stop bit for each frame of data. Data can be exchanged between the microcontroller 112 and the GSM modem 114 over multiple frames. In other embodiments, the communications module 114 may be a conventional modem that is configured to communicate using a protocol supported by at least one of the wireless networks of network 118.

The microcontroller 112 is configured to update the stored unlock input combination data in response to lock configuration data received from the lock management device 140 via the communications module, where the lock configuration data includes an indication of one or more specified combinations that are to be added to, or removed from, the set of unlock input combinations for the smart lock 120.

Figure 5:
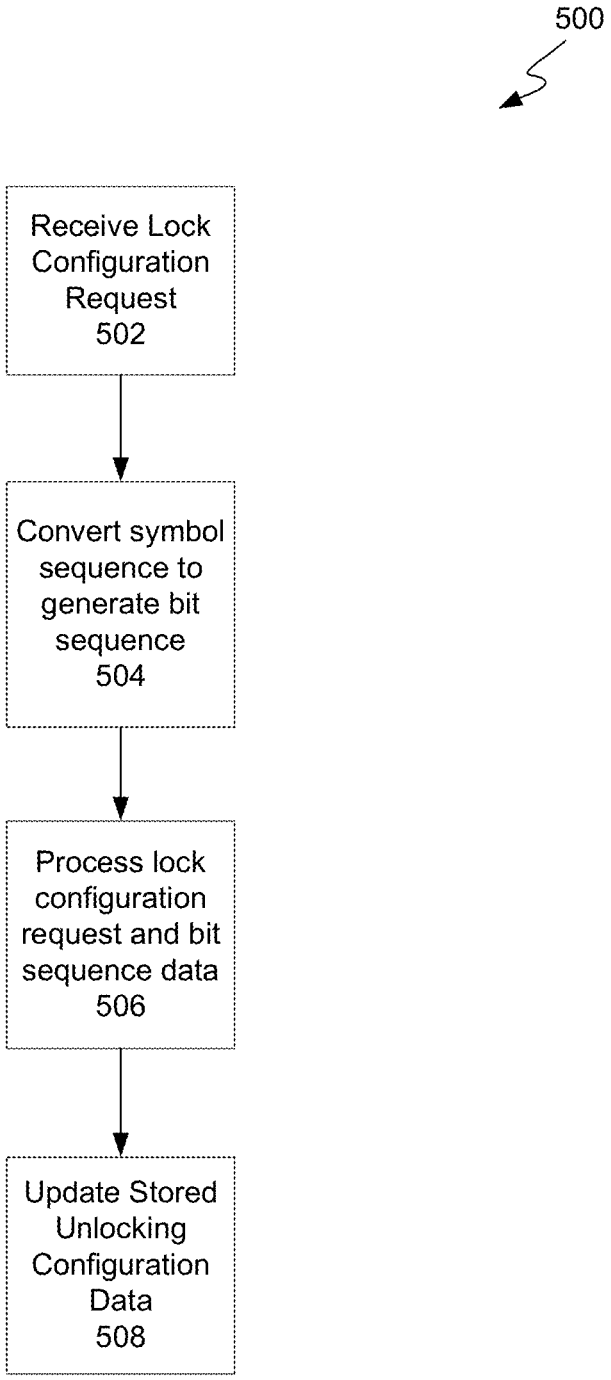
FIG. 5 is a flow diagram of a process for configuring the unlock input combinations of the smart lock in accordance with some embodiments of the present invention.

FIG. 5 illustrates the process of receiving lock configuration data from the lock management device 140. At step 502, the smart lock 120 receives a lock configuration request containing the lock configuration data. The lock configuration data includes a high-level representation of the corresponding symbol sequence for each specified combination, and an indication of whether the combination is to be added to the set of unlock input combinations, or removed from this set.

For example, the locking configuration request may be in the form of an SMS message containing a text string "123 ADD" indicating that the combination represented by the symbol sequence '1', '2' and '3' for respective combination wheels W1, W2 and W3 is to be added to the unlock input combination for the smart lock 120. At step 504, the microcontroller 112 buffers the received locking configuration data in volatile memory 304 and converts the high level symbol sequence of each specified combination into a corresponding bit sequence representing the input bits that are received at the I/O module 310 from the detection circuitry when the specified combination corresponds to the selected combination (i.e. when a user manipulates the components 110 to input the combination by selecting the corresponding high-level symbol sequence).

At step 506, the locking configuration request and corresponding generated bit sequence data are processed by the microcontroller 112, and the stored unlock input combination data is updated at step 508 in accordance with the request. Specifically, when the lock configuration request indicates that the specified combination is to be added to the unlock input combination data, the CPU 302 transfers the generated bit sequence to memory 304 and stores the sequence as part of the unlock input combination data. When the specified combination is to be removed from the unlock input combination data, the CPU compares the generated bit sequence data to each sequence presently stored in the unlock input combination data, and removes a stored sequence if a match is found.

As part of step 508, in some embodiments the microcontroller 112 is configured to process condition data included in the lock configuration data received from the lock management device 140. The condition data is in respect of one or more of the specified unlock input combinations, and includes at least one of: i) a start time value indicating a time when the specified combination is to be added to, or removed from, the set of unlock input combinations, such that the updating of the stored unlock input combination data with the specified combination occurs at the start time; and ii) a time duration value indicating a time period for which the specified combination is to be added to, or removed from, the set of unlock input combinations, such that the specified combination is again removed from, or added back to, the stored unlock input combination data respectively after the expiry of the time period. CPU 302 processes time and date data by comparison of the indicated value with the value of an internal timeclock. The specified combinations and corresponding condition data is stored in volatile memory 304. A scheduling routine is performed by the CPU 302 periodically to: check the start time, and an expiry time calculated as the start time+the duration (if applicable), associated with a specified combination; and to update the stored unlock input combination data in respect of the specified combination in accordance with the timing conditions.

Lock Status and Updates

In the described embodiments, microcontroller 112 is configured to store lock status data and lock operation data. Lock status data includes an indication of the present state of the fastener 106, and an indication of a time value when the fastener 106 transitioned into this state. The state of the fastener is maintained as a single bit in volatile memory 304 which is modified by CPU 302 when the state of the fastener 106 is changed as a result of the generation of fastening control signals (as described above). For example, when the position of the fastener is changed (i.e. as a result of fastener control signals being generated in response to the selected configuration matching to an unlock input combination) lock status data is generated by the microcontroller.

In some embodiments, the lock status data includes logging data representing transitions of the fastener 106 from the locked to the unlocked state. Microcontroller 112 is configured to generate transition data including a time value representing the time and date when the transition occurred. The logging data is stored in volatile memory 304, and may be restricted to a predetermined size such as to prevent overflow and/or excessive consumption of the memory 304 by the logging data.

In the described embodiments, lock operational data includes at least one of: battery usage data for the battery 116; and unlocking operation data indicating the unlock input combinations represented by the presently stored unlock input combination data. Power supply module 314 is configured to provide the CPU 302 with battery usage data indicating the power remaining within the battery 116. Microcontroller 112 is configured to periodically poll power supply module 314 to obtain the battery data, and to store the data in memory 304. In some embodiments, the CPU 302 is configured to process the battery data and to compare an indication of the remaining battery power to one or more threshold levels. For example, the microcontroller 112 may determine that the power remaining within battery 116 is below 15% of total capacity based on a comparison of the indicated value of the remaining battery power to a corresponding 15% threshold power level value, as stored in non-volatile memory 306.

Figure 7:
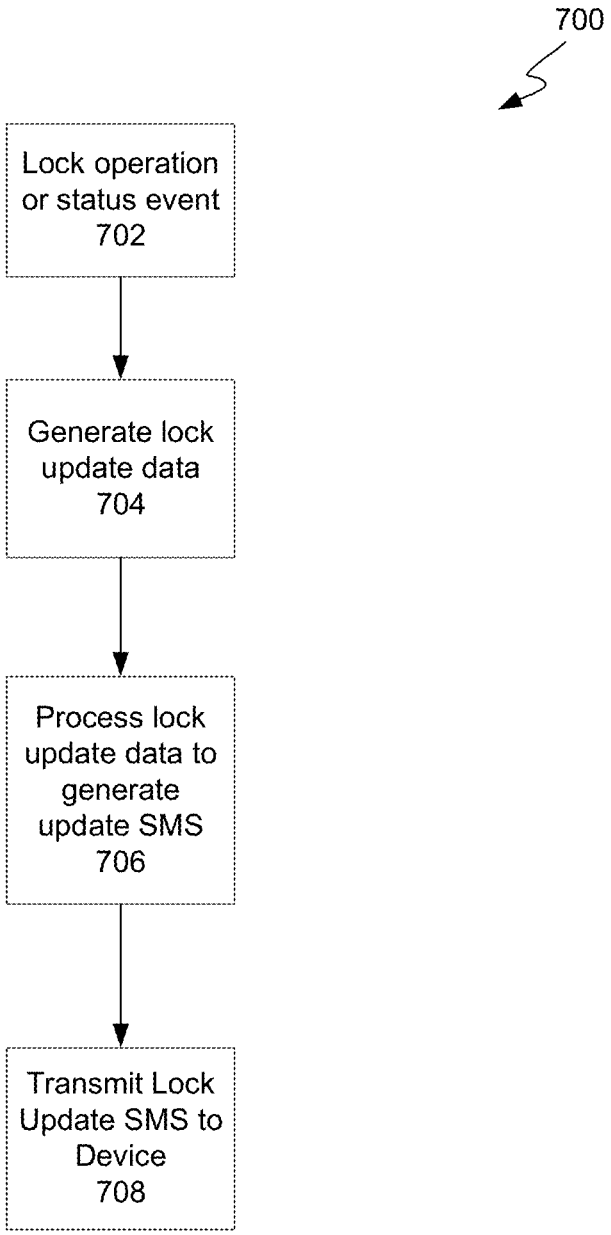
FIG. 7 is a flow diagram of a process for transmitting a lock update from the smart lock to a lock management device of the smart lock in accordance with some embodiments of the present invention.

The microcontroller 112 is configured to transmit lock update data to a lock management device 140 of the lock management system 130 via the GSM modem 114. FIG. 7 illustrates the process of providing a lock update to the lock management device 140 in accordance with the described embodiments. At step 702, a lock operation, or a lock status event, occurs which triggers the microcontroller 112 to perform a lock update. The lock status event can include, for example, a determination by the microcontroller 112 that the power remaining within battery 116 is low (i.e. below a predetermined threshold value). A lock operation can include, for example, the opening of the lock from a closed state.

In some embodiments, the lock status event can be generated in response to the passing of a predetermined amount of time since the transmission of the most recent lock update to the lock management device 140, and/or any other device of the lock management system 130. The microcontroller 112 can be configured to perform a lock update when one or more arbitrary status and/or operational conditions are met. For example, the microcontroller 112 can be programmed to perform an update when the lock is opened for the first time after an extended period (i.e. where the time between two successive transitions from a closed state to an open state exceeds some threshold time value).

In some embodiments, a lock status event is generated in response to the application of an external force to the lock, such as a shearing or compressive force. The application of a force to the lock 120 is detected via one or more sensors connected to the microcontroller 112 and configured to measure external forces acting on one or more components of the lock, such as, for example, the fastener 106 and/or the body 104. The microcontroller 112 is configured to generate a lock status event if the force measured by a sensor exceeds a pre-determined threshold value. The threshold value can be set to correspond to the force required to cause structural damage to the respective lock components. This allows the lock management device to receive notification that the functionality of the lock may be compromised as a result of the detected force.

At step 704, the microcontroller 112 is configured to process the lock status and operational data to generate lock update data. In the described embodiments, the each lock update contains an indication of both the status and operational data of the lock. In other embodiments, particular lock updates can be performed in respect of separate lock status and/or operational events. CPU 302 retrieves the lock status and operational data from memory 304. Lock update data is generated by a process involving the conversion of the low-level representation of each unlock input combination represented within the unlock input combination data into the corresponding symbol sequences (i.e. conversion of the bit sequence representing the series of expected input values to a user readable combination of digits effective to open the lock).

The lock update data is transmitted from the CPU 302 to serial port 312 via bus 303, and is received by the GSM modem 114. GSM modem 114 processes the lock update data to produce a lock update in the form of an SMS message for transmission over the GSM network 118 (i.e. at step 706). GSM modem 114 maintains device identification data for one or more lock management devices of the lock management system 130 to which lock update messages are to be transmitted (referred to as "update devices"). In the described embodiments, the update devices include the single lock management device 140 which the smart lock 120 is registered to, and the device identification data is a mobile telephone number associated with the lock management device 140.

At step 708, the GSM modem 114 transmits the lock update message to the update device via an SMS sent to the mobile telephone number represented by the device identification data using the GSM network 118. In other embodiments, the lock update message can be transmitted to multiple devices, such as the registered lock management device 140 and a lock management central server device, or similar. The lock management device identification data can include additional information, such as for example an IP address specifying a particular device on a local network to which the lock update message is delivered.

Lock Management System and Device

Figure 4:
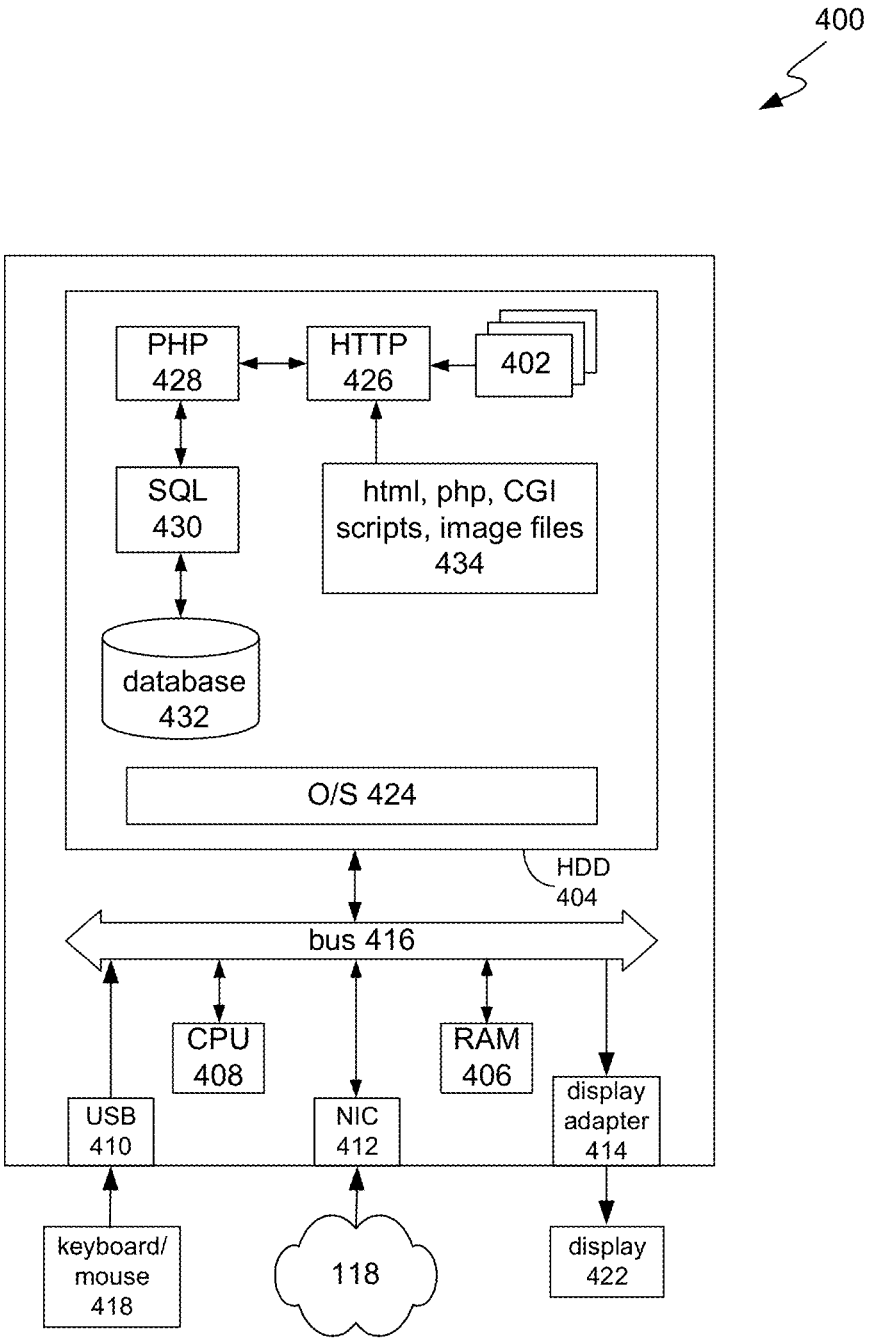
FIG. 4 is a block diagram of a computing device within the smart lock system.

With reference to FIG. 1, smart lock 120 is managed by a lock management system 130 including at least one lock management device 140 that is configured to execute a lock management application 144. In the described embodiments of the smart lock system 100, the lock management device 140 and the user device 102 are implemented as one or more standard computing devices, such as, for example, an Intel IA-32 based computer system as shown in FIG. 4, and the processes executed by the system 400 are implemented as programming instructions of one or more software modules 402 stored on non-volatile (e.g., hard disk or solid-state drive) storage 404 associated with the computer system. However, it will be apparent that at least parts of these processes could alternatively be implemented as one or more standard computer systems 400, such as, for example, an Intel Architecture computer systems (e.g. desktop or laptop workstations), or as configuration data of field programmable gate arrays (FPGAs), and/or as one or more dedicated hardware components, such as application-specific integrated circuits (ASICs), for example. In other embodiments, the lock management device 140 and/or the user device 102 can each be implemented as a mobile computing device, such as, for example, computer systems having a 32- or 64-bit Advanced RISC Machine (ARM) architecture (e.g., ARMvx), and which operate analogously to the standard computing system 400 depicted in FIG. 4.

The system 400 includes random access memory (RAM) 406, at least one processor 408, and external interfaces 410, 412, 414, all interconnected by a bus 416. The external interfaces include communication interfaces 410, at least one of which is connected to a keypad or keyboard 418 and optionally a pointing device such as a mouse 419, a network interface connector (NIC) 412 which connects the system 400 to a communications network, such as the GSM network 118, and a display adapter 414, which is connected to a display device such as an LCD or LED panel display 422. The display device can be configured with a touch screen to receive input from a user of the system 400.

The system 400 also includes a number of standard software modules 426 to 430, including an operating system 424 such as Android, iOS, Linux or Microsoft Windows. When implemented as a lock management device 140, software modules of the system 400 include a lock management application 144, a communications module 142 and a user interface 146. In embodiments where the system 400 is a workstation, the system 400 can include web server software 426 such as Apache, available at http://www.apache.org, scripting language support 428 such as PHP, available at http://www.php.net, or Microsoft ASP, and structured query language (SQL) support 430 such as MySQL, available from http://www.mysql.com, which allows data to be stored in and retrieved from an SQL database 432.

In some embodiments, the system 400 includes a database 432, which is implemented using SQL and is accessed by a database management system (DBMS). In other embodiments, the database 432 may be implemented on a separate computing device, or across multiple computing devices according to one or more techniques for the distributed processing and storage of data.

Figure 8:
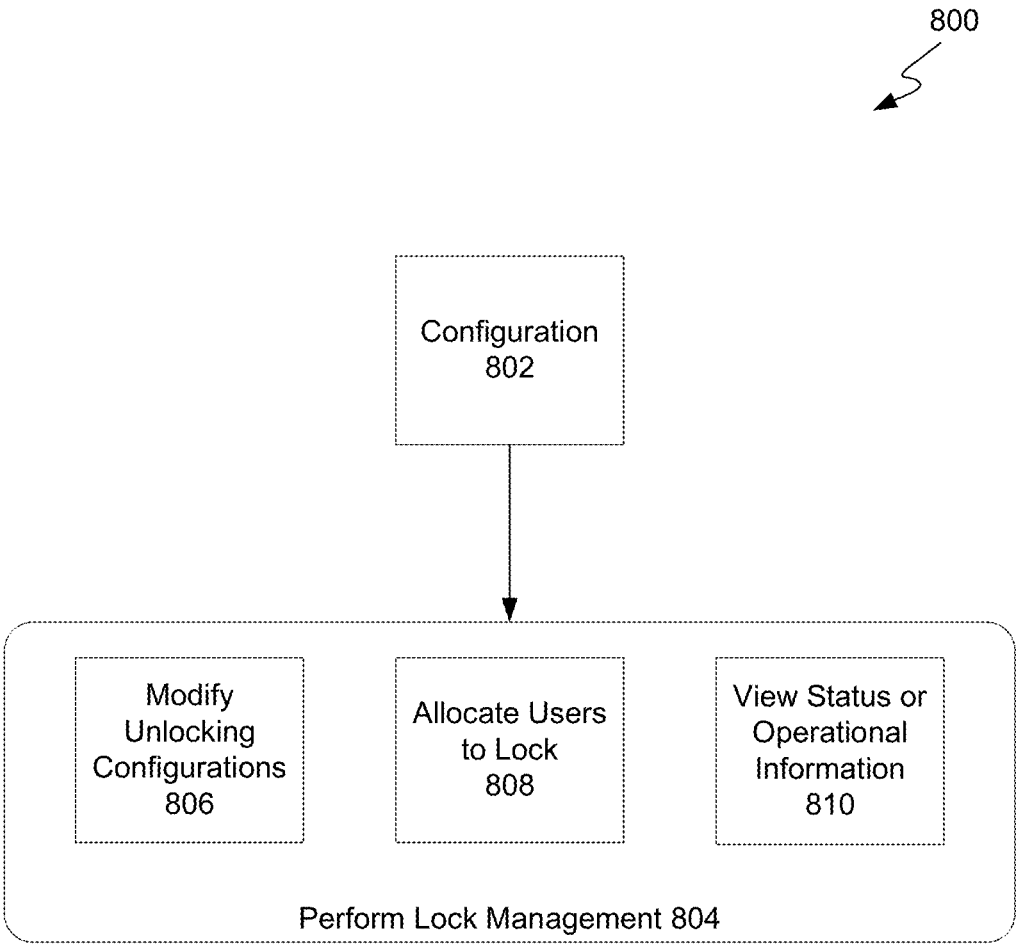
FIG. 8 is a flow diagram of a process for operating the lock management device to manage the smart lock in accordance with some embodiments of the present invention.

An administrator 105 operates the lock management device 140 to remotely manage smart lock 120 via an application account of the lock management application 144. FIG. 8 illustrates the process 800 by which administrator 105 manages the smart lock 120. At step 802, the lock management application 144 is configured for use by the administrator 105. Lock management application 144 can be obtained from a digital distribution platform appropriate to the operating system of the lock management device 140 (such as, for example, Google play store or Apple Store).

Figure 9:
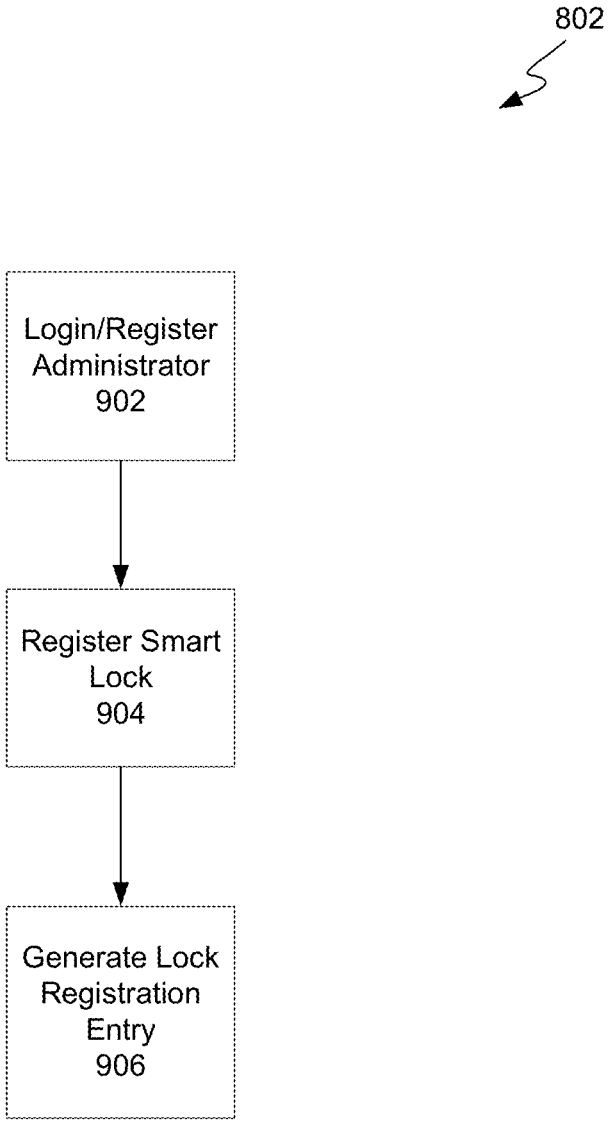
FIG. 9 is a flow diagram of a process for configuring the lock management device as part of the process for operating the lock management device to manage the smart lock.

As shown in FIG. 9, the administrator 105 performs a login and/or registration process with the lock management application 144, at step 902. Registration of the administrator 105 is performed if the administrator 105 has not previously registered with the lock management system 130. Registration involves the provision of an application account to the administrator 105 which is accessible via a login process that involves the administrator 105 supplying identification credentials to the lock management system 130, such as for example a username and password combination. The identification credentials are determined during registration with the lock management system 130, where each respective credential can be supplied by the system 130 automatically, or chosen by the administrator 105 subject to particular requirements.

At step 904, the administrator 105 registers the smart lock 120 with their lock management application 144 account. The registration process involves providing the lock management application 144 with a unique identifier of the smart lock 120 (a "smart lock identifier"). In the described embodiments, the smart lock identifier is a serial number of the smart lock. In other embodiments, the smart lock identifier can be in the form of a SIM-card number (corresponding to a mobile telephone number) associated with the particular smart lock. The lock management application 144 generates lock registration request data containing the smart lock identifier and device identification data of the lock management device 140.

In the described embodiments, the lock management device 140 is uniquely identified by a mobile telephone number by which SMS messages can be sent to the lock management device 140. The lock registration request data is transmitted to the smart lock 120 via GSM network 118 in the form of an SMS message. The microcontroller 112 processes the lock registration request data and verifies that the smart lock identifier supplied in the lock registration request data matches to the actual identifier of lock 120, as represented by data stored in the non-volatile memory 306 or GSM modem 114. On positive verification, GSM modem 114 stores the device identification data for the purpose of transmitting lock updates to the lock management device 140 (as described above), and transmits registration success message data, representing a registration success message, to the lock management device 140 via SMS.

The lock management device 140 processes the registration success message to confirm registration of the smart lock 120. In some embodiments, this can involve the display of a corresponding registration notification message on the user interface 146 of the lock management device 140. At step 906, the lock management application 144 generates a lock registration entry for the application account of the administrator 105 in respect of smart lock 120. The lock registration entry specifies the unlock input combinations for the smart lock 120. Directly following registration the unlock input combinations consist of a particular default unlock input combination. The unlock input combination data of the microcontroller 112 represents the default unlock input combination that can be used to open the smart lock 120 when the lock is registered with the lock management device 140. The default unlock input combination is represented in non-volatile memory 306 such as to ensure that smart lock 120 has at least one unlock input combination that can be used to open the lock in the event that the electronic components are power cycled (e.g. due to a failure of the battery 116). The lock management application 144 allows the administrator 105 to allocate one or more users 101 to the smart lock 120, as described herein below, and the lock registration entry specifies the allocated users for smart lock 120.

Figure 3B:
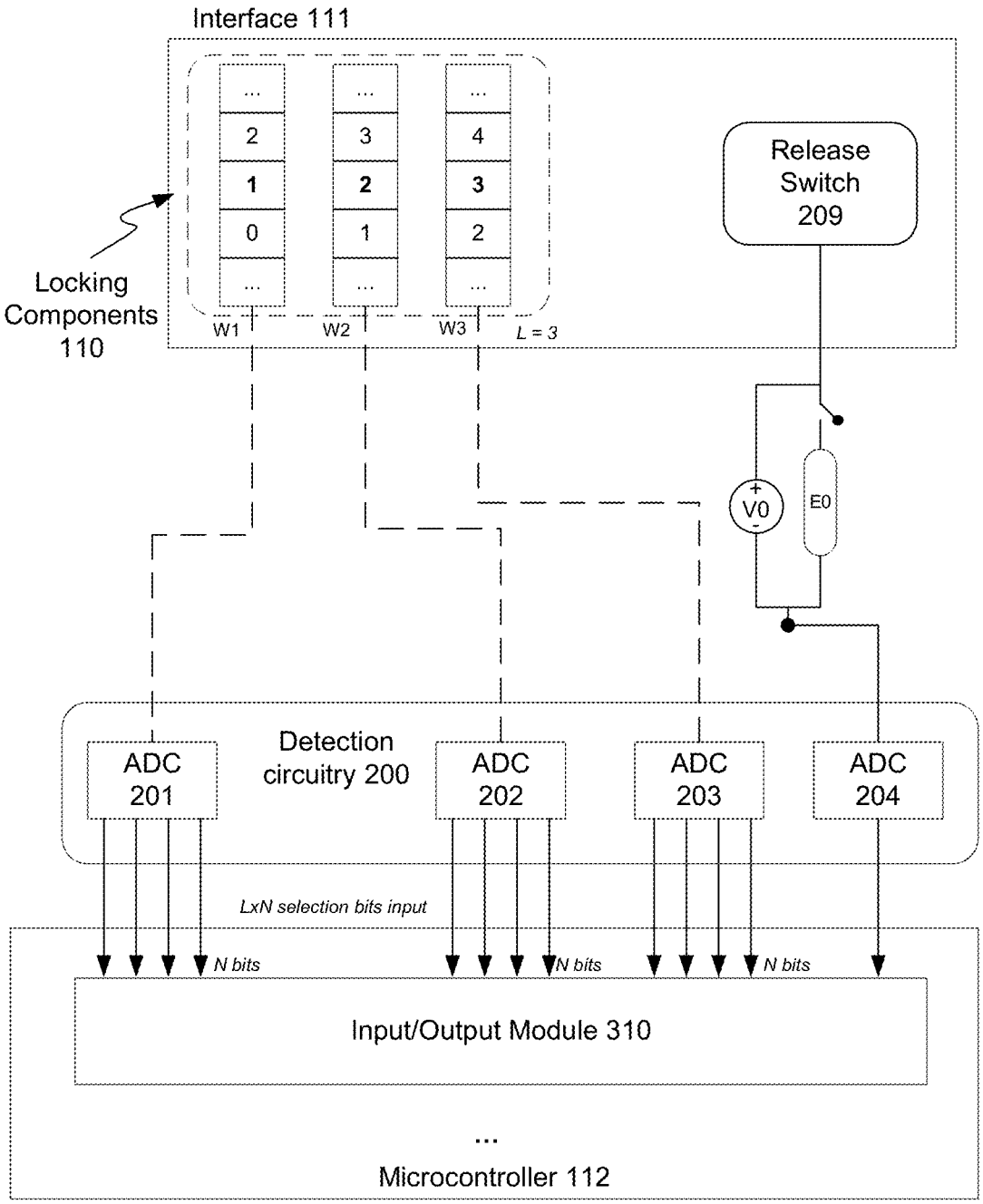
FIG. 3*b* is a block diagram of locking components including a release switch, the detection circuitry, and the microcontroller of the smart lock.

In some embodiments, the smart lock 120 includes an emergency disarm (or "quick access") mechanism which operates to allow the lock to be opened without manipulation of the locking components. FIG. 3*b* illustrates an exemplary implementation in which the microcontroller 112 is configured to receive a release bit signal, as generated based on the operation of a release switch (or button) 209, in addition to the N-bit selection signal generated in respect of the combination wheel locking components W1-W3. Release switch 209 is a mechanical switch in the described embodiments, however in other embodiments the release switch may be implemented as an electromagnetic or electronic switch. In some embodiments the switch 209 is configured to be operated remotely, such as by Bluetooth, Wi-Fi, or other wireless communication protocol. The release signal is generated by an ADC 204 based on the resistance value of a release element E0, in a similar manner to that described above for the generation of selection signals for elements E1-E10. When the emergency disarm mechanism is active, the lock can be opened by manipulation of the locking components W1-W3, such that their configuration matches to an unlocking configuration, or by the use of the release switch 209. In some embodiments, the emergency disarm mechanism may be active only when certain conditions are met (e.g. where the microcontroller 112 detects a fault with the locking components and/or the corresponding selection signals).

In some embodiments, the disarm mechanism is remotely operable by the administrator 105 via the lock management application 144 (i.e. without the requirement of the user operating a physical release switch or button). In the event that the locking components are damaged and/or defective, the administrator 105 can transmit an emergency disarm message, via SMS through GSM network 118 as described above, to the smart lock 120. The lock management device 140 generates emergency disarm data in the form of an emergency disarm message including a disarm code of the smart lock. The disarm code can be a unique number, character and/or symbol sequence specific to the lock which, when processed by the microcontroller 112, will trigger the opening of the fastener.

The lock management device 140 transmits the emergency disarm data (i.e. message) to the smart lock. The emergency disarm message is received by the GSM modem 114, and processed by the microcontroller 112 resulting in the opening of the lock (i.e. by the generation of fastener control signals to cause the fastening components to move the fastener into the unlocked position) without the selected configuration necessarily matching to an unlock input combination.

With reference to FIG. 8, following the configuration stage (i.e. at step 802) administrator 105 operates lock management application 144 to perform one or more lock management operations (i.e. at step 804). In the described embodiments, the lock management operations that can be performed include: modifying the unlock input combinations of the smart lock 120 (at step 806); allocating one or more users to the smart lock 120, and assigning particular unlock input combinations to one or more of the allocated users (at step 808); and viewing the operational and/or status information of the smart lock 120 (at step 810).

Figure 10:
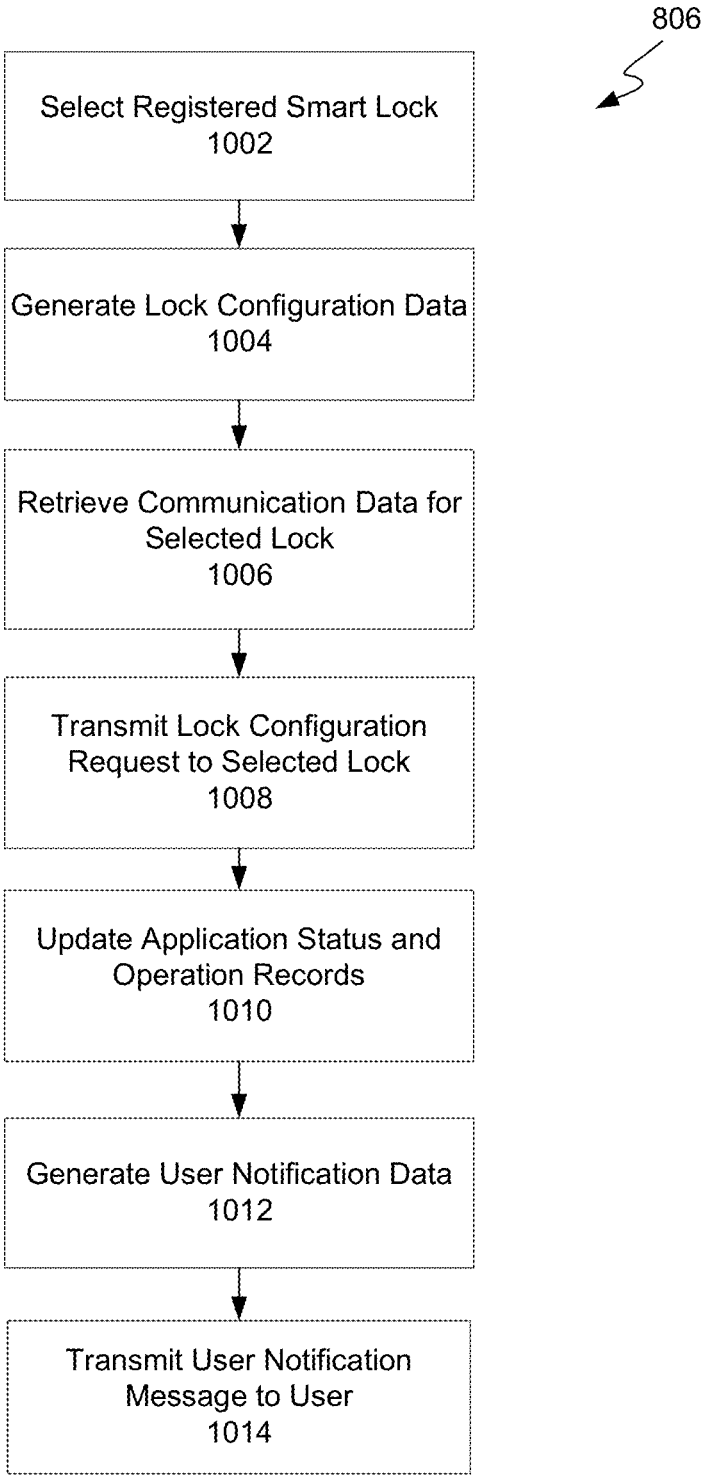
FIG. 10 is a flow diagram of a process for modifying the unlock input combinations of the smart lock as part of the process for operating the lock management device to manage the smart lock.

Administrator 105 can operate the lock management application 144 to modify the unlock input combinations of the smart lock 120 according to the process shown in FIG. 10. At step 1002, the administrator 105 selects smart lock 120 from a set of registered smart locks. The lock management device 140 generates smart lock selection data representing the selection of the smart lock 120 from the one or more registered smart locks. At step 1004, lock configuration data is generated by the lock management application 144 including: i) one or more specified unlock input combinations of the locking components 110 of selected smart lock 120 which are to be added to, or removed from, the stored unlock input combinations of the smart lock 120; and ii) an indication of whether each specified unlock input combination is to be added to, or removed from, the set of unlock input combinations of the smart lock 120.

The administrator 105 interacts with the lock management application user interface 146 to provide an indication of whether each specified unlock input combination is to be added to, or removed from, the current set of unlock input combinations for lock 120. That is, in the described embodiments, the lock management application 144 allows the administrator 105 to add and/or remove particular specified unlock input combinations within a single lock configuration request. In other embodiments, a single lock configuration request may be restricted to only add to, or remove from, the set of presently stored unlock input combinations for smart lock 120.

Generation of the lock configuration data involves generation of a representation of the specified unlock input combinations. When the specified combinations are new unlock input combinations (i.e. are combinations to be added to the present set of unlock input combinations), the new unlock input combinations can be nominated by the administrator 105. For example, the administrator 105 can interact with elements of the user interface module 146 to input the symbol (i.e. digit) sequence "123" representing a new unlock input combination for lock 120. In some embodiments, the lock management application 144 provides an option for the creation of a new unlock input combination based on a randomly produced symbol sequence. For example, the administrator 105 may select a "generate random combination" button on the user interface 146 resulting in the randomly generated sequence "591". To remove an unlock input combination of the smart lock 120, the administrator 105 selects the unlock input combination to be removed from the set of unlock input combinations currently maintained by the smart lock 120, as included within the lock registration entry for lock 120 (as described above).

Generation of the lock configuration data also involves the administrator 105 providing an indication of any conditions that apply to the modification of the set of unlock input combinations in respect of each specified combination. Lock management application 144 displays user interface elements 146 allowing the administrator 105 to enter a start time, duration, and/or other arbitrary conditions for the modification of the set of unlock input combinations of lock 120, as discussed above.

At steps 1006 and 1008, the lock management application 144 is configured to transmit the lock configuration data to the smart lock 120 in the form of a lock configuration request message. The lock configuration request message is transmitted to the smart lock 120 based on lock communication data maintained by the lock management application 144. The communication data is generated by the lock management application 144 at the time of registration of the smart lock 120 with the account of administrator 105, and includes a mobile number enabling SMS messages to be delivered to the smart lock 120. The lock configuration request message is in the form of a SMS message, and is transmitted to the smart lock 120 via the GSM network 118.

At step 1010, status and operational records maintained by the lock management application 144 for smart lock 120 are updated in respect of the lock configuration request. The specified unlock input combinations are added to, or removed from, the unlock input combination set within the lock registration entry to maintain consistency with the unlock input combinations that are stored within microcontroller 112 of the lock 120. In other embodiments, the smart lock 120 can be configured to transmit an acknowledgement response to the lock management device 140 to indicate the successful receipt of the lock configuration request. In such embodiments, the updating of the status and operational records by the lock management application 144 can be performed subject to the receipt of this acknowledgement response.

Following the transmission of the lock configuration request to the smart lock 120, at step 1012 the lock management device 140 is configured to generate user notification data to notify a particular user 101 of a modification performed to the unlock input combinations of the smart lock 120. User 101 can be a particular user selected by the administrator 105 from the users that are allocated to the smart lock 120 (referred to as the "allocated users", as described below), or a user who is specified by the administrator 105 at the time of the selection of the smart lock 120 (i.e. at step 1002).

In some embodiments, the user notification data is transmitted to a predetermined set of users allocated to the smart lock 120 automatically by the lock management application 144 when a lock configuration request is transmitted to the smart lock 120. The process performed by the lock management device 140 at step 1012 includes: i) retrieving user data representing a user 101 of the smart lock 120; ii) generating user notification data representing a user notification for the user 101, the user notification data including: at least one of the specified combinations included within the lock configuration data transmitted to the smart lock (i.e. as part of the lock configuration request); and an indication that the at least one specified combination is to be added to, or removed from, the set of unlock input combinations for smart lock 120; and iii) transmitting the user notification data to a user device 102 of the user 101, where the user device 102 is determined by the user data.

In the described embodiments, the user notification data is transmitted to the user 101 as a lock notification SMS message that is sent to the user device 102 via GSM network 118. The lock notification SMS message is produced according to a predetermined form. Transmission to the user device 102 occurs based on the user data, which includes contact information provided by the user 101 when the user 101 registers with the lock management system 130 (as described below). In the described embodiments, the user device 102 is a mobile computing or smartphone device allowing the delivery of the lock notification SMS message using the mobile telephone number of the user device 102 (as specified by the contact information of the user 101).

The lock management application 144 is configured to update the status and operational information maintained in respect of smart lock 120, and in response to receiving lock update data from the lock, at the lock management device 140. Specifically, the lock management device 140 is configured to: receive lock update data from the smart lock 120, the lock update data including lock status data representing, at least, the present state of the fastener 106 of the lock 120 and an indication of a date-time value of the most recent transition to this present state; and process the lock update data to generate lock usage data representing usage information in respect of the lock 120 over a particular period of time. The lock update data can also include lock operation data of the lock 120 representing at least one of: an indication of the power level of the battery 116 of the smart lock 120; and an indication of the set of unlock input combinations represented by the unlock input combination data of the smart lock 120.

The lock usage data can include a series of usage entries each representing a transition of the lock from the closed state to the open state, and a corresponding date-time value indicating when the transition occurred. Each usage entry can be cross-referenced by the lock management application 144 to determine the set of users allocated to the lock 120 at the time of the transition. This allows the administrator 105 to gain insight into which users may be responsible for the opening of the lock 120 during a particular time period.

The lock management application 144 can also be configured to produce operational log data including a list of operational events and/or modifications to the unlock input combinations that occurred to the smart lock 120 over a particular period of time. For example, the operational log data may represent a history of the battery level over a one-month period allowing the administrator 105 to schedule battery replacement and/or charging for future time periods. The lock management application 144 allows the administrator 105 to view the usage and/or operational information of the smart lock 120 (i.e. at step 810) via particular user interface elements configured to render the usage entries and/or operational log information for display on the lock management device 140. The administrator 105 can perform additional data management and capturing functions with the displayed information, such as printing the information and/or exporting the information to a text based, or other, file format.

Allocation of Users to a Lock

With reference to FIG. 8, at step 808 the lock management device 140 is configured to allocate one or more users to the smart lock 120 for the purpose of managing the permissions of particular users to open the smart lock 120. Administrator 105 can interact with the user interface module 146 of the lock management application 144 to select the user 101 from a list of users in order to allocate user 101 to the smart lock 120. The list of users can include users that are registered with the lock management system 130 (referred to as "registered users").

Registration of user 101 involves the lock management system 130 obtaining contact information of the user 101, including their name, and the mobile telephone number of the user device 102. The lock management application 144 ensures that the mobile telephone number provided by the user 101 is unique among the mobile telephone numbers of all currently registered users for successful registration of user 101. The registration process can be performed by any lock management device of the lock management system 130, such that the lock management application executing on any particular lock management device has access to the user data generated during the registration of user 101.

The user allocation process performed by the lock management device 140 involves: i) generating user association data representing the association of user 101 to the particular smart lock 120; ii) generating user configuration data representing one or more unlock input combinations of the locking components of lock 120, where the unlock input combinations are assigned to the user 101 for operation of lock 120; and iii) transmitting, to the user device 102, an indication that user 101 is allocated to the lock 120, and an indication of a least one of the unlock input combinations that are assigned to the user 101. The unlock input combinations assigned to user 101 can be newly generated unlock input combinations which are added to the set of unlock input combinations for lock 120 (i.e. via an unlock input combination modification operation, as in step 806). Alternatively, the administrator 105 can select a pre-existing unlock input combination of lock 120 to assign to user 101.

In some embodiments, the allocation of user 101 to smart lock 120 can occur based on a request made by the user 101 to access the smart lock 120. That is, the lock management application 144 can be configured to receive lock access request data representing a request by user 101 to access lock 120, or any other registered smart lock. In this case, the allocation of user 101 to lock 120 can be in response to the received lock access request, and can involve: processing the received lock access request data to generate lock scheduling data representing the current allocation of one or more users to corresponding unlock input combinations of each of one or more smart locks registered to the administrator 105; and determining a particular smart lock 120 registered to the administrator 105 which user 101 is to be allocated to based, at least in part, on the lock scheduling data.

In the described embodiments, the lock access request data can be in the form of an access request SMS transmitted to the lock management device 140 by a device of the user 101, such as the user device 102. The lock management application 144 can be configured to select smart lock 120 from a plurality of registered smart locks based on the allocation of other users to each registered smart lock, and/or the prior usage, or operation, of the registered smart locks as indicated by the corresponding usage and operational information of each lock.

The lock management application 144 updates the scheduling data following the allocation process to indicate that user 101 is now allocated to smart lock 120, and to indicate the unlock input combinations assigned to user 101 in respect of the smart lock 120. The assignment of unlock input combinations to the user 101 can be for the duration of a predetermined access interval, where the access interval corresponds to a period of time for which each of the one or more unlock input combinations assigned to the user 101 are effective to open smart lock 120.

For example, the user 101 may request access to a smart lock managed by the lock management device 140 for a period of two hours commencing at the time of the request. The lock management application 144 can be operated to: allocate user 101 to smart lock 120; modify the unlock input combination set of smart lock 120 to add a new unlock input combination for the requested access period; notify user 101 of the unlock input combination that has been added such as to permit user 101 to open the lock using this new unlock input combination; and update the usage and operational information maintained by the application for smart lock 120, in accordance with the methods described herein above.

Many modifications will be apparent to those skilled in the art without departing from the scope of the present invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A combination lock, including:

locking means operable to move between a first position in which the lock is in a locked state and a second position in which the lock is in an unlocked state;

a set of mechanical combination inputs operable by a user of the lock to define an input combination; and a controller having a network interface and being configured to receive via the network interface one or more unlock combinations, and wherein the controller is configured to operate the locking means to place the lock in the unlocked state in response to a user operating the set of mechanical combination inputs to define an input combination that matches any one of the one or more unlock combinations, wherein the controller includes:

a communications module configured to communicate with a lock management device via a communications network;

a microcontroller in communication with the communications module, and connected to the set of mechanical combination inputs, where the microcontroller is configured to:

store unlock combination data representing the one or more unlock combinations associated with the unlocked state of the lock;

compare data representing a present configuration of the mechanical combination inputs to data representing the one or more unlock combinations; and generate, when the selected configuration matches an unlock combination represented by the unlock combination data, fastener control signals to cause one or more fastening components to move a fastener to a position to place the lock in the unlocked state;

where the lock includes a power source configured to power, at least, the microcontroller and the communications module of the lock, wherein the microcontroller is configured to receive one or more input signals indicating an activated element for each respective mechanical combination input, and wherein the input signals are output by detection circuitry configured to receive one or more selection signals corresponding to the activated element for each respective mechanical combination input.

2. The combination lock of claim 1, wherein the selection signals are generated, at least in part, based on an electrical resistance value of the corresponding activated element of each mechanical combination input.

3. The combination lock of claim 1, wherein the selection signals are generated, at least in part, based on an optical signal produced by the generation and detection of a light beam by respective optical emitter and sensor components of the combination lock.

4. The combination lock of claim 1, wherein the selection signals are generated, at least in part, based on changes in the strength of a magnetic field generated by each respective mechanical combination input, where the strength of the magnetic field generated by a mechanical combination input varies according to the active element of the mechanical combination input.

5. The combination lock of claim 1, wherein the microcontroller is configured to: update the stored unlock combination data in accordance with lock configuration data, said lock configuration data including an indication of one or more specified unlock combinations that are to be added to, or removed from, the set of stored unlock combinations.

6. The combination lock of claim 5, wherein the lock configuration data is received from a lock management device via the communications module.

7. The combination lock of claim 5, wherein the lock configuration data is generated by the microcontroller of the lock, and where the one or more specified unlock combinations of the generated lock configuration data are determined via an unlock combination generation process of the lock.

8. The combination lock of claim 7, wherein the unlock combination generation process of the lock is a One Time Passcode (OTP) generation process performed by the microcontroller of the lock.

9. The combination lock of claim 5, wherein the lock configuration data includes, for each of the one or more specified unlock combinations, at least one of:

a start time value indicating a time when the specified combination is to be added to, or removed from, the set of unlock combinations, such that the updating of the stored unlock combination data with respect to the specified combination occurs at the start time; and a time duration value indicating a time period for which the specified combination is to be added to, or removed from, the set of unlock combinations, such that the specified combination is again removed from, or added back to, the stored unlock combination data respectively after the expiry of the time period.

10. The combination lock of claim 9, wherein the microcontroller is configured to transmit lock update data to the lock management device via the communications module, the lock update data including any one or more of:

i) lock status data indicating, at least, the present state of the lock and an indication of a date-time-location value of the most recent transition to said state; and ii) lock operation data including at least one of:

battery usage data indicating the amount of power remaining in the battery of the lock; and unlocking operation data indicating the unlock combinations represented by the presently stored unlock combination data.

11. The combination lock of claim 10, wherein the lock operational data includes lock synchronisation data that, when processed by the lock management device, synchronises the unlock combination generation process of the smart lock with a corresponding process of the lock management device.

12. The combination lock of claim 1, wherein the set of mechanical combination inputs includes a keypad or a set of mechanical combination reels, wheels or dials.

13. The combination lock of claim 1, wherein the set of mechanical combination inputs includes a set of mechanical combination reels.

14. A lock management system for managing a combination lock, including:

a lock management device, including:

a communications interface to receive data;

at least one computer processor to execute program instructions; and a memory, coupled to the at least one computer processor, to store program instructions for execution by the at least one computer processor to automatically:

generate lock selection data representing the selection of a lock from one or more combination locks registered to an administrator of the lock management device;

generate lock configuration data including an indication of one or more unlock combinations of a set of mechanical combination inputs of the selected lock, said set of mechanical combination inputs being operable by a user to define an input combination, the one or more unlock combinations being associated with an unlocked state of the selected lock; and transmit the lock configuration data to the selected lock via the communications interface, and where the selected lock is the combination lock in accordance with claim 5.

15. The lock management system of claim 14, wherein the lock management device is configured to:

retrieve user data representing a user of the combination lock;

generate user notification data representing a user notification for the user of the combination lock, the user notification data including:

at least one of the specified unlock combinations of the set of mechanical combination inputs included within the lock configuration data transmitted to the combination lock; and an indication that the at least one specified unlock combination is to be added to, or removed from, the set of unlock combinations for the combination lock; and transmit the user notification data to a user device of the user, said user device determined by the user data.

16. The lock management system of claim 14, wherein the lock management device is configured to:

receive lock update data from a registered lock, the registered lock being any of the one or more combination locks registered to the administrator, the lock update data including: i) lock status data representing, at least, the present state of the registered lock and an indication of a date-time-location value of the most recent transition to said state; and ii) lock operation data representing at least one of:

an indication of the power level of the battery of the registered lock; and an indication of the set of unlock combinations represented by the unlock combination data of the registered lock; and process the lock update data to generate lock usage data representing usage information for the registered lock over a particular period of time.

17. A lock management system for managing a combination lock, including:

a lock management device, including:

a communications interface to receive data;

at least one computer processor to execute program instructions; and a memory, coupled to the at least one computer processor, to store program instructions for execution by the at least one computer processor to automatically:

generate lock selection data representing a selection of a lock from one or more combination locks registered to an administrator of the lock management device; and generate lock configuration data including an indication of one or more unlock combinations of a set of mechanical combination inputs of the selected lock, said set of mechanical combination inputs being operable by a user to configure the mechanical combination inputs in accordance with a desired input combination, the one or more unlock combinations being associated with an unlocked state of the selected lock, where the one or more unlock combinations of the generated lock configuration data are the same one or more unlock combinations that are determined via an unlock combination generation process of the selected lock, and where the selected lock is the combination lock in accordance with claim 5.

18. The lock management system of claim 17, wherein the unlock combination generation process of the selected lock is a One Time Passcode (OTP) generation process performed by the microcontroller of the selected lock.

19. The lock management system of claim 18, wherein the lock management device is configured to:

generate lock configuration data indicating the one or more unlock combinations by performing a corresponding One Time Passcode (OTP) generation process that is synchronised with the OTP generation process of the selected lock; and transmit, via the communications interface, the generated lock configuration data to a user device of a user of the selected lock.

20. A method for managing a combination lock, including:

storing, within the combination lock, unlock combination data representing one or more unlock combinations of the combination lock, the combination lock having a set of mechanical combination inputs being operable by a user of the combination lock to configure the mechanical combination inputs in accordance with a desired input combination;

comparing, by the combination lock, data representing the configuration of the set of mechanical combination inputs to data representing the one or more unlock combinations;

generating, by the combination lock, when the configuration of the set of mechanical combination inputs matches an unlock combination represented by the unlock combination data, fastener control signals to cause one or more fastening components to move a fastener from a first position in which the combination lock is in a locked state to a second position in which the combination lock is in an unlocked state; and updating, by the combination lock, the stored unlock combination data in response to lock configuration data received from a lock management device, said lock configuration data including an indication of one or more specified unlock combinations that are to be added to, or removed from, the set of stored unlock combinations.

21. The method of claim 20, wherein the set of mechanical combination inputs includes a keypad or a set of mechanical combination reels, wheels or dials.

22. The method of claim 20, wherein the set of mechanical combination inputs includes a set of mechanical combination reels.

* * * * *